US006621220B1

(12) United States Patent
Hasegawa et al.

(10) Patent No.: US 6,621,220 B1
(45) Date of Patent: Sep. 16, 2003

(54) ENVELOPE AND IMAGE-FORMING APPARATUS USING THE SAME

(75) Inventors: Mitsutoshi Hasegawa, Yokohama (JP); Kazuya Shigeoka, Yokohama (JP); Yutaka Arai, Atsugi (JP); Hiroharu Ueda, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/694,503

(22) Filed: Oct. 24, 2000

Related U.S. Application Data

(63) Continuation of application No. PCT/JP00/01030, filed on Feb. 23, 2000.

(30) Foreign Application Priority Data

Feb. 25, 1999 (JP) ..... 11-049196

(51) Int. Cl.[7] ..... H01J 17/16
(52) U.S. Cl. ..... 313/634; 313/477 R
(58) Field of Search ..... 220/2.1 R, 2.3 R, 220/2.3 A, 2.1 A; 313/477 R, 634

(56) References Cited

U.S. PATENT DOCUMENTS 4,303,847 A * 12/1981 Glaser ..... 313/493
5,936,342 A 8/1999 Ono et al. ..... 313/495

FOREIGN PATENT DOCUMENTS

JP 8-83578 3/1996
JP 9-82245 3/1997

* cited by examiner

*Primary Examiner*—Vip Patel
(74) *Attorney, Agent, or Firm*—Fitzpatrick, Cella, Harper & Scinto

(57) ABSTRACT

An envelope includes a face plate, a rear plate arranged so as to be opposite to the face plate, an outer frame arranged between the face and rear plates and surrounding a circumference, and a face plate joining portion for joining the outer frame and the face plate. A rear plate joining portion joins the outer frame and the rear plate to each other, with one or both of the face plate joining portion and the rear plate joining portion including a sealant having a seal function and an adhesive having an adhesive function.

27 Claims, 20 Drawing Sheets

(a) STRIPE (b) MATRIX

ENVELOPE AND IMAGE-FORMING APPARATUS USING THE SAME

This application is a con't of PCT/JP00/01030 filed Feb. 23, 2000.

TECHNICAL FIELD

The present invention relates to an envelope capable of airtightly maintaining the interior, an image-forming apparatus using this envelope, and a manufacturing method of the envelope.

BACKGROUND ART

In the envelope capable of maintaining the interior in a vacuum (pressure reducing state), frit (low melting point glass) is conventionally used as a bond in a joining portion of a face plate (phosphor substrate), a rear plate (electron-emitting substrate) and an outer frame.

Namely, a frit layer is formed as the bond in the joining portion and is next burned so that the joining portion is airtightly sealed and attached and the interior of the envelope can be maintained in a vacuum. In this seal attachment of glass using frit, burning at about 400 to 500° C. is required in the atmosphere (normal pressure).

In an image-forming apparatus generally utilizing electrons, it is necessary to arrange the envelope constructed by the face plate as a glass member, the rear plate and the outer frame and maintaining the vacuum (pressure reducing) atmosphere, an electron source for emitting electrons, its driving circuit, an image-forming member having a phosphor, etc. for emitting light in collision with electrons, an accelerating electrode for accelerating the electrons toward the image-forming member, its high voltage power source, etc.

FIG. 19 is a perspective view of the image-forming apparatus using an electron-emitting device disclosed in Japanese Patent Application Laid-open No. 8-83578. FIG. 20 is a cross-sectional view taken along the line B–B' of this image-forming apparatus.

As shown in FIG. 19, a rear plate (electron-emitting device substrate) 1701 and a face plate 1702 are joined (or sealed and attached) to each other in a joining portion to an outer frame 1703 through frits 1704, 1705. In this figure, the rear plate 1701 is made of blue plate glass, and the face plate 1702 is made of blue plate glass, and the outer frame 1703 is also made of blue plate glass. Reference numerals 1706, 1707 and 1708 respectively designate upper wiring, a device electrode (upper wiring side) and an electroconductive thin film including an electron-emitting portion. Reference numerals 1709 and 1710 respectively designate a phosphor and a metal back. Lower wiring and a device electrode (lower wiring side) are not illustrated.

As disclosed in Japanese Patent Application Laid-open No. 9-082245, there is a case in which a getter is arranged to maintain the vacuum in the image-forming apparatus using a flat envelope as in a thin type image-forming apparatus.

An object of the present invention is to realize a preferable envelope, a preferable image-forming apparatus and a manufacturing method of the preferable envelope.

DISCLOSURE OF THE INVENTION

One of the inventions of an envelope in the present application is constructed as follows.

Namely, the present invention resides in an envelope constructed by combining plural members and airtightly maintaining an internal space with respect to the exterior, wherein the envelope has a joining portion airtightly joining the members to each other by a sealant having a seal function, and the airtight joining is reinforced by an adhesive having an adhesive function.

Here, the meaning of airtightly maintaining the internal space with respect to the exterior is that the internal space is independently held in an allowable range with respect to the exterior. For example, if the internal space is in a pressure reducing state, the above meaning is that the invasion of substances from the exterior is restrained in an allowable range. When there is a predetermined substance in the internal space, the above meaning is that the invasion of substances from the exterior is restrained in an allowable range, and leakage of the predetermined substance from the internal space to the exterior is restrained in an allowable range.

The above sealant may not have the adhesive function, but preferably has the adhesive function to a certain extent.

In the above invention, the function of the sealant can be suitably fulfilled. A condition in manufacture is particularly strict in a material having the seal and adhesive functions as a unit. However, the envelope having preferable characteristics can be realized in a preferable condition by using the sealant and the adhesive.

In particular, the above adhesive is preferably arranged in the above invention such that the adhesive is in contact with the above joining portion.

Further, in each invention mentioned above, the above adhesive is preferably arranged outside the internal space airtightly maintained by the above sealant. This construction is particularly preferable when no substance emitted from the adhesive is desirable with respect to the internal space in comparison with a substance emitted from the sealant, and when an influence on the internal space due to the undesirable substance emitted from the adhesive with respect to the internal space is larger than an influence on the internal space due to the undesirable substance emitted from the sealant with respect to the internal space.

In each invention mentioned above, the above sealant is preferably formed by a material able to perform a seal process at a temperature equal to or lower than 400° C. Further, the above sealant is preferably constructed by a material having a melting point equal to or lower than 400° C.

The above sealant preferably includes a metal, and is also preferably formed by a metal or an alloy. In particular, In can be preferably used as the metal.

In each invention mentioned above, a surface processing material may be also arranged in a position in which the above members are in contact with the above sealant. Wettability with the sealant is improved by the surface processing material, and the sealant can be more reliably sealed.

Further, the present application includes the invention of an envelope having an electron source within the interior of the envelope of each invention mentioned above.

Further, the present application includes the invention of an image-forming apparatus having the envelope of each invention mentioned above and an image-forming member arranged within the envelope.

In particular, the electron source is arranged within the above envelope, and the above image-forming member preferably forms an image by irradiating electrons outputted from the electron source. Further, a control electrode for controlling the above electrons may be arranged therein. For example, a grid electrode and an anode electrode are preferably used as the control electrode.

A member for emitting light by electroluminescence (EL) may be used as the image-forming member.

One invention of a manufacturing method of the envelope included in the present application is constructed as follows.

Namely, the manufacturing method of the envelope of the present application is a manufacturing method of an envelope constructed by combining plural members and airtightly maintaining an internal space with respect to the exterior, wherein the manufacturing method includes a first process for airtightly joining the members to each other by a sealant having a seal function and a second process for reinforcing the airtight joining by an adhesive having an adhesive function.

In particular, the second process is preferably performed after the first process.

Further, the present application includes the following invention as an invention of the envelope.

Namely, the present invention resides in an envelope comprising a face plate, a rear plate arranged oppositely to the face plate, an outer frame arranged between the face and rear plates and surrounding a circumference, a face plate joining portion for joining the outer frame and the face plate, and a rear plate joining portion for joining the outer frame and the rear plate to each other. The face plate joining portion and/or the rear plate joining portion include a sealant having a seal function and an adhesive having an adhesive function.

BEST MODE FOR CARRYING OUT THE INVENTION

Figure 1:
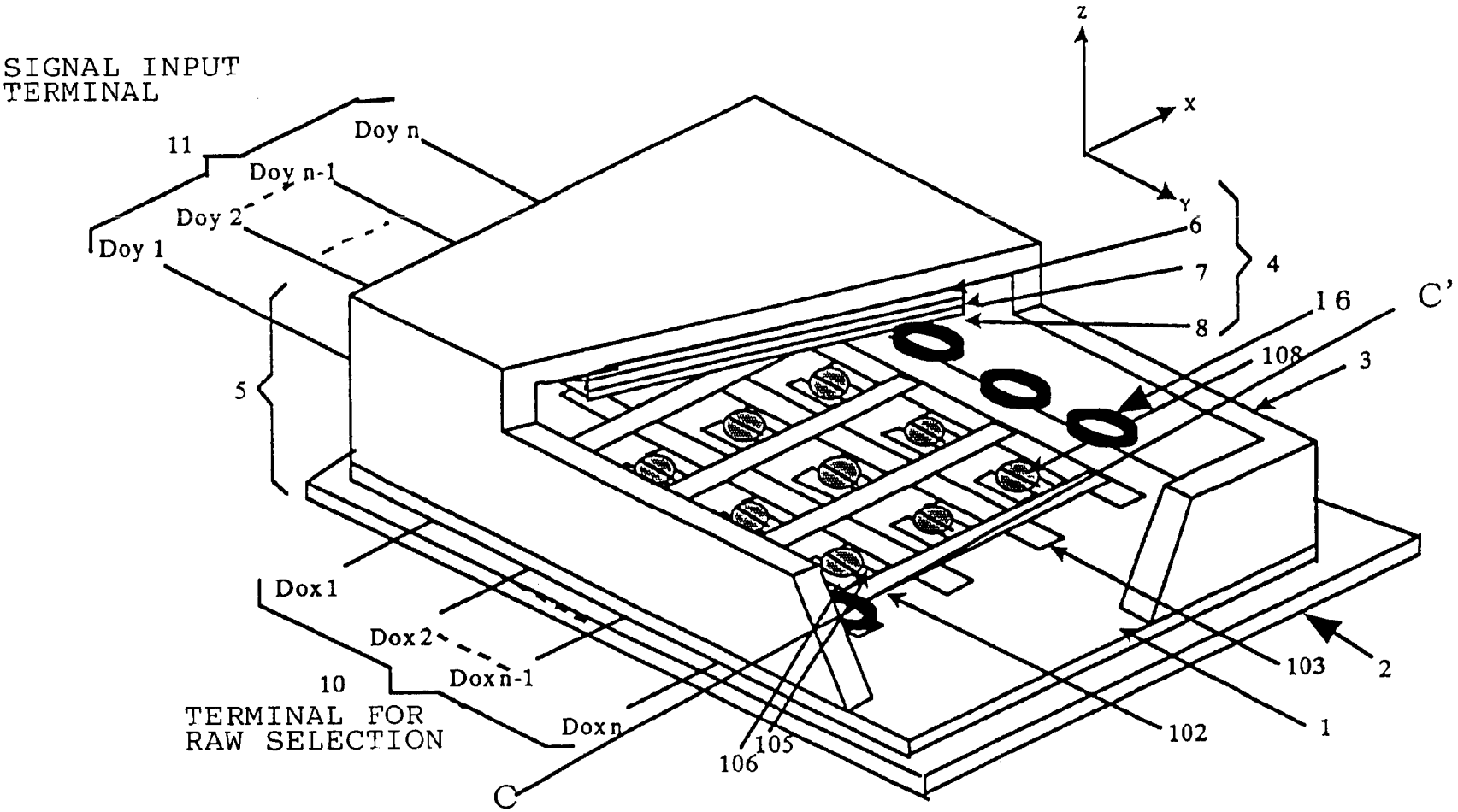
FIG. 1 is a perspective view of an image-forming apparatus of the present invention.

The conditions of materials, etc. are set as follows in a best mode for carrying out the present invention.

1. Heat resisting property is required in a bake (high vacuum forming) process in a vacuum.
2. Seal property is required. Namely, it is necessary that a high vacuum can be maintained (local minimum of vacuum leak and local minimum of gas permeation). This condition may be satisfied in only a portion requiring the vacuum maintenance.
3. Adhesive property to a glass member is required.
4. It is necessary to set a small gas emitting amount to maintain the initial high vacuum.
5. It is necessary to set a highest heat treatment temperature to be lower than about 400° C. in a frit adhesion (seal attachment) process.
6. It is necessary to have a molding property in which it is easily fit for an arbitrary shape of the outer frame and no fluidization is caused near an adhesive temperature.

A sealant having the seal function of a joining portion satisfying the above conditions can be selected from metals or alloys of In, Al, Cu, Au, Ag, Pt, Ti, Ni, etc., and materials, etc. such as organic adhesives, inorganic adhesives, etc. having surfaces coated with metals or alloys of In, Al, Cu, Au, Ag, Pt, Ti, Ni, etc. The adhesive having an adhesive function is constructed as an adhesive of the present invention by a polymeric thermoplastic adhesive having a polyphenyl compound, an adhesive having polybenzimidazole resin as a principal component, an organic adhesive such as an adhesive having polyimide resin as a principal component, etc., an inorganic adhesive having alumina, silica, zirconia and carbon as principal components, etc.

In is used as one of most preferable sealants of the present invention, and an inorganic adhesive having zirconia and silica as principal components is used as one of most preferable adhesives of the present invention. When In wire is used as the sealant, the In wire is molded in an arbitrary shape and is heated at a temperature equal to or higher than 160° C. so that In is softened and press-attached. After In is then sealed in a temperature drop process, a peripheral portion of the sealant is coated with the adhesive of a paste shape having alumina as a principal component by a dispenser, etc. After moisture is evaporated at a temperature equal to or lower than 100° C., the adhesive is adhered at a temperature of about 150° C. Thus, the above conditions 1 to 6 can be satisfied. It is particularly preferable that the bond using the inorganic adhesive having In and alumina as principal components has a low highest heat treatment temperature in comparison with the other joining portions.

Further, the inorganic adhesive of a paste shape having zirconia and silica as principal components is molded as the sealant in an arbitrary shape by the dispenser, etc. Moisture is evaporated from the inorganic adhesive at a temperature equal to or lower than 100° C. Then, a coating film of In is formed on a surface of the inorganic adhesive by electron beam (EB) evaporation, sputtering, etc. Thereafter, In is softened and press-attached by heating In at a temperature equal to or higher than 160° C. After In is sealed in a temperature drop process, a peripheral portion of the sealant is coated with the adhesive of a paste shape having alumina as a principal component by the dispenser, etc. After moisture is then evaporated at a temperature equal to or lower than 100° C., the adhesive is adhered at about 150° C. Thus, the above conditions 1 to 6 can be satisfied.

Further, Al is used as the sealant, and a polymeric thermoplastic organic adhesive having polyether ketone as a principal component is used as the adhesive. Al as the sealant and the polymeric thermoplastic organic adhesive of a sheet shape having polyether ketone as a principal component as the adhesive are molded in an arbitrary shape, and are heated to a temperature equal to or higher than 330° C. Thus, the adhesive is softened, press-attached and sealed. The adhesive is adhered by hardening the adhesive in a temperature drop process. Thus, the above conditions can be satisfied.

The joining portion using at least two members of the above sealant having the seal function and the adhesive having the adhesive function is formed in an adhesive process at a highest heat treatment temperature equal to or lower than 400° C. Accordingly, it is possible to provide an envelope as well as an image-forming apparatus in which power consumption in a manufacturing process is reduced and a reduction in luminance and life shortening are reduced and display quality is high and getter effects are sufficient.

Further, to improve close contact property of the joining portion and a glass substrate, it is also effective to vacuum-evaporate a metal or an alloy similar to the sealant on a joining face in advance, or coat the joining face with a coating material including a similar metal or alloy by a known coating method such as screen printing, dipping, spraying, a dispenser, etc.

The envelope of the present invention can be used in an image-forming apparatus and is preferably used in the image-forming apparatus in which a phosphor and an electron accelerating electrode are formed in the face plate of the envelope and an electron source is formed in the rear plate. A surface conduction type electron-emitting device is most preferably used as an electron-emitting device used in this electron source. However, the present invention can be also preferably applied to an image-forming apparatus using a cold cathode of a MIM (metal/insulator/metallic structure), FE (electrolytic emission), etc. and requiring a high vacuum.

The image-forming apparatus most preferably using the present invention and using the surface conduction type electron-emitting device will next be explained with reference to the drawings.

FIG. 1 is a perspective view of the image-forming apparatus of the present invention. Reference numeral 1 designates an electron source in which plural electron-emitting devices are arranged on a substrate and suitable wiring is formed. Reference numerals 2, 3 and 4 respectively designate a rear plate, an outer frame and a face plate. Reference numerals 9 and 14 respectively designate an adhesive and a sealant.

Figure 2:
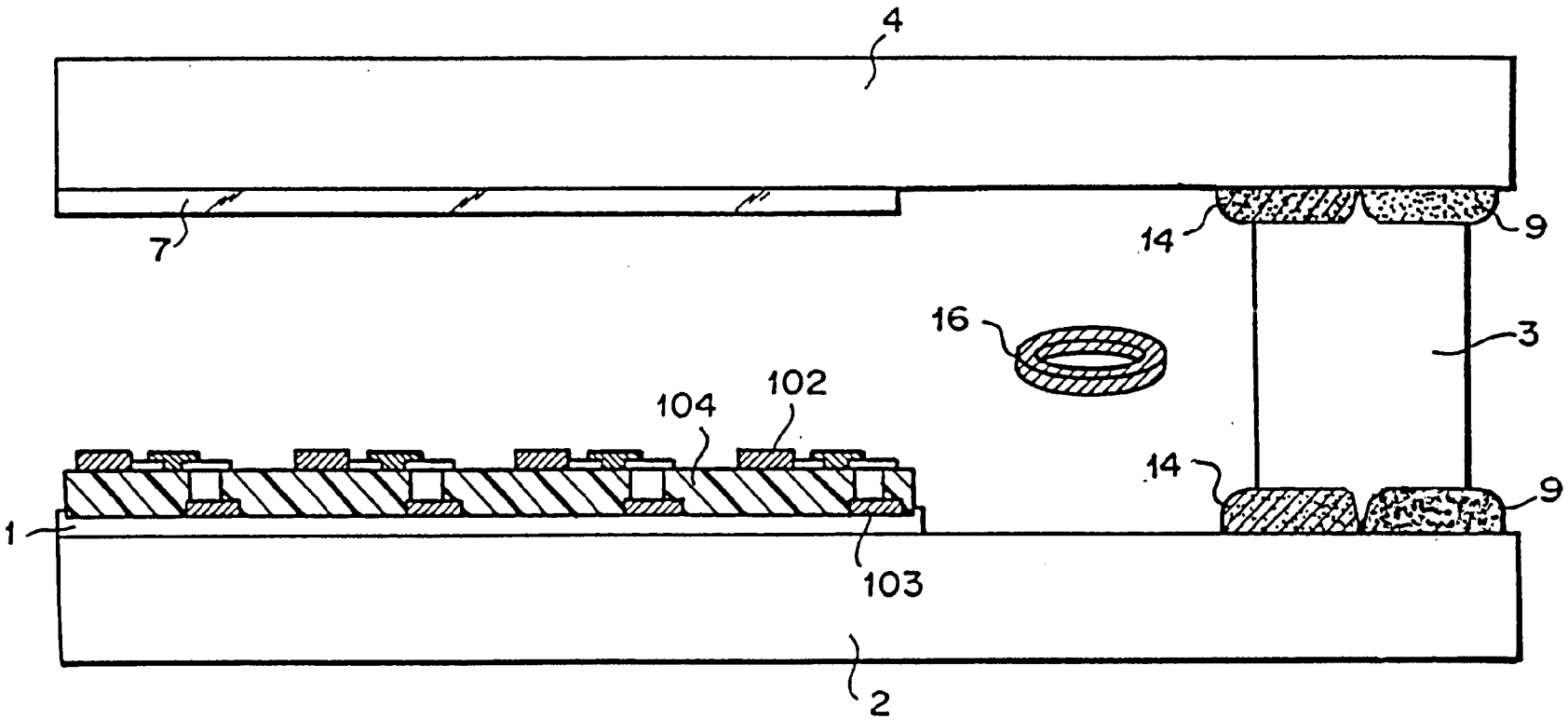
FIG. 2 is a cross-sectional view taken along line C–C' of FIG. 1.

FIG. 2 is a cross-sectional view taken along the line C–C' of FIG. 1. As shown in FIG. 2, the rear plate 2 and the face plate 4 are joined to each other in a joining portion to the outer frame 3 through the sealant 14 having a seal function and the adhesive 9 having an adhesive function.

When the outer frame and the face plate, or the outer frame and the rear plate are integrated with each other in advance, the present invention is suitably used in joining of the face plate and the rear plate.

In the face plate 4, a fluorescent film 7 and a metal back 8 are formed on a glass substrate 6, and this portion becomes an image display area. In the case of a black-and-white image, the fluorescent film 7 is constructed by only a phosphor. However, when a color image is displayed, pixels are formed by phosphors of the three primary colors of red, green and blue, and are separated from each other by a black member. The black member is called a black stripe, a black matrix, etc. in accordance with its shape.

The metal back 8 is constructed by a thin film of Al, etc. The metal back 8 also has a function for improving luminance by reflecting light transmitted to the electron source 1 among light generated from the phosphors in a direction of the glass substrate 6, and preventing that a gas left within the envelope 5 is ionized by an electron beam and the phosphors are damaged by a shock of generated ions. Further, the metal back 8 prevents accumulation of electrons by giving an electroconductive property to an image display area of the face plate 4 and functions as an anode electrode with respect to the electron source 1.

Figure 3:
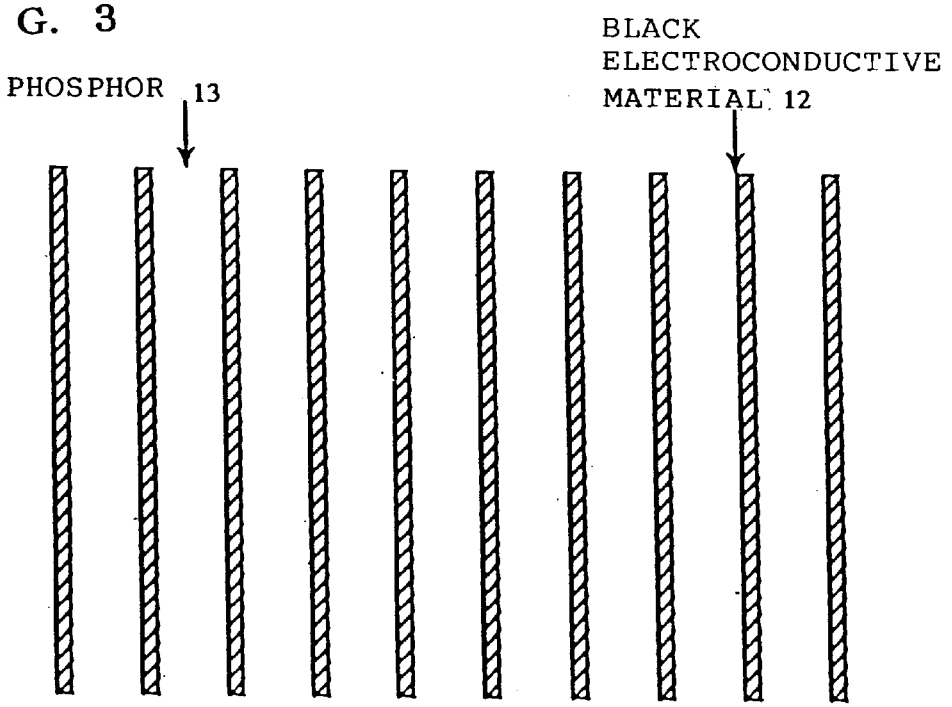
FIG. 3 is an arrangement view of a phosphor.
Figure 3:
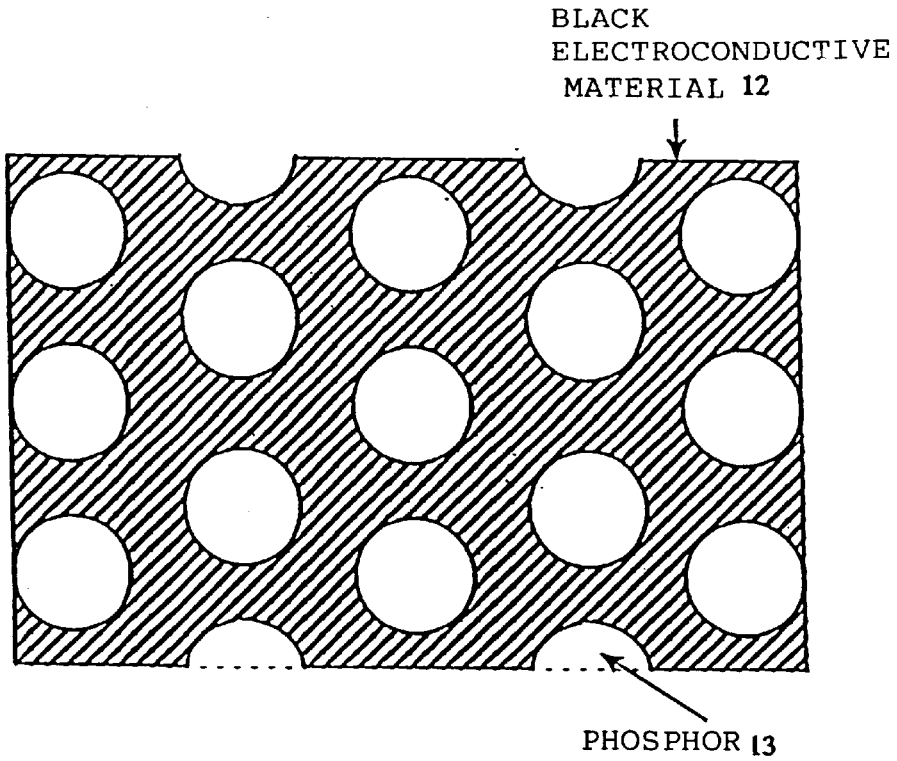

(a) of FIG. 3 shows a case in which the phosphors 13 are arranged in a stripe shape. The phosphors 13 of the three primary colors of red (R), green (G) and blue (B) are sequentially formed and are separated from each other by the black member 12. In this case, a portion of the black member 12 is called a black stripe.

In (b) of FIG. 3, dots of the phosphors 13 are arranged in a grid shape and are separated from each other by the black member 12. In this case, the black member 12 is called a black matrix. There are several kinds of arrangement methods of the respective colors of the phosphors 13. Accordingly, there is a case in which an illustrated triangular grid, a square grid, etc. are adopted as an arrangement type of the dots in accordance with the arrangement methods.

A slurry method, a printing method, etc. can be used as a patterning method of the black member 12 and the phosphors 13 on the glass substrate 6. After the fluorescent film 7 is formed, a metal such as Al, etc. is further formed and is set to the metal back 8.

Figure 4:
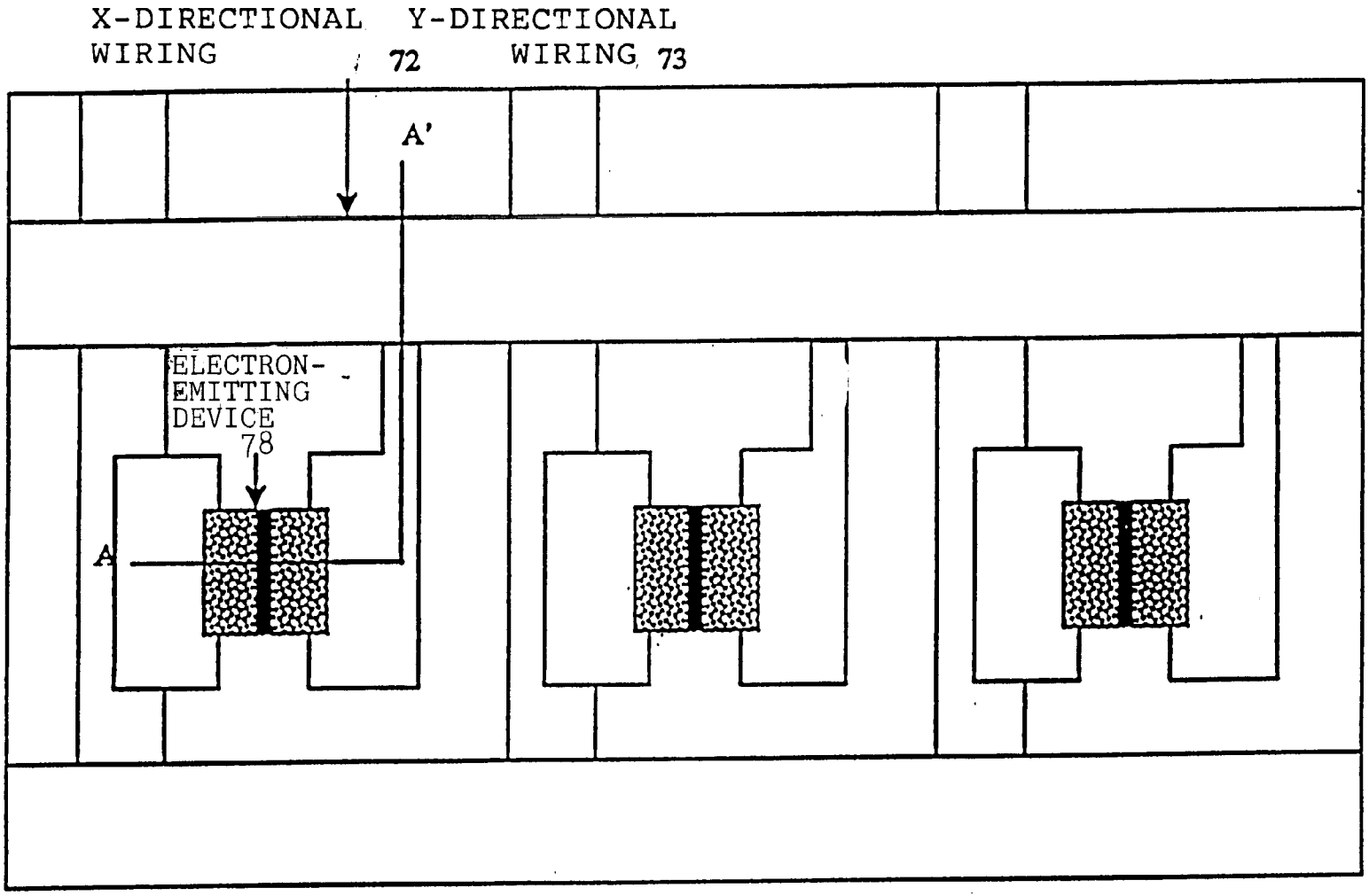
FIG. 4 is a plan view of an electron source of matrix connection.
Figure 5:
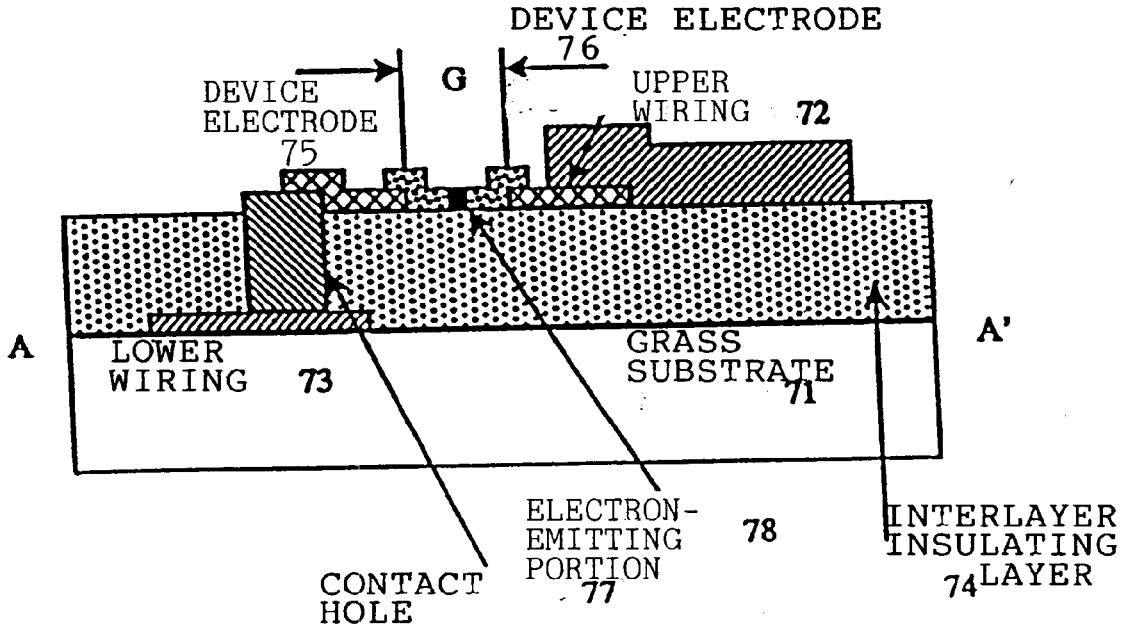
FIG. 5 is a cross-sectional view taken along the line A–A' of FIG. 4.

FIG. 4 is a plan view of a two-dimensional electron source connected by matrix wiring. FIG. 5 is a cross-sectional view taken along line A–A' of FIG. 4.

X-directional wiring (upper wiring) 72 and Y-directional wiring (lower wiring) 73 are respectively connected to an electron-emitting device 78. The Y-directional wiring 73 is arranged on an insulating substrate 71. An insulating layer 74 is further formed on the Y-directional wiring 73. The X-directional wiring 72 and the electron-emitting device 78 are formed on this insulating layer 74. The Y-directional wiring 73 and the electron-emitting device 78 are connected to each other through a contact hole 77.

The above various kinds of wirings are formed by a combination of various kinds of thin film depositing methods such as a sputtering method, a vacuum evaporation method, a plating method, etc., and a photolithography technique, or a printing method, etc. However, it is particularly preferable to use the printing method since the wirings can be formed in a large area at low cost.

The face plate 4, the outer frame 3, the rear plate 2, the electron source 1 and the other structures are combined with each other, and the outer frame 3, the face plate 4 and the rear plate 2 are joined to each other. In the joining, the sealant 14 having a seal function is molded in an arbitrary shape, and the adhesive is softened and press-attached by heating processing at a temperature equal to or lower than 400° C. The sealant is hardened and sealed in a temperature drop process, and is adhered by the adhesive so that the joining is performed (seal attachment process). An internal structure such as the electron source 1 is similarly fixed. It is desirable to reduce oxygen density and temperature in an allowable range at this adhering time.

Thereafter, the interior of the envelope 5 is once exhausted. Subsequently, a sufficient vacuum is secured within the envelope 5 by gas exhaust and heating degasification (baking process). Further, an unillustrated vacuum degree exhaust pipe is heated and sealed and cut by a burner so that an airtight container is formed.

In the image-forming apparatus (airtight container) made in this way, power consumption in a manufacturing process is reduced and a reduction in luminance and life shortening are reduced and display quality is high and getter effects are sufficient. Accordingly, the vacuum degree within the envelope is preferably maintained so that an electron emitting amount from the electron-emitting device is stabilized.

Figure 6:
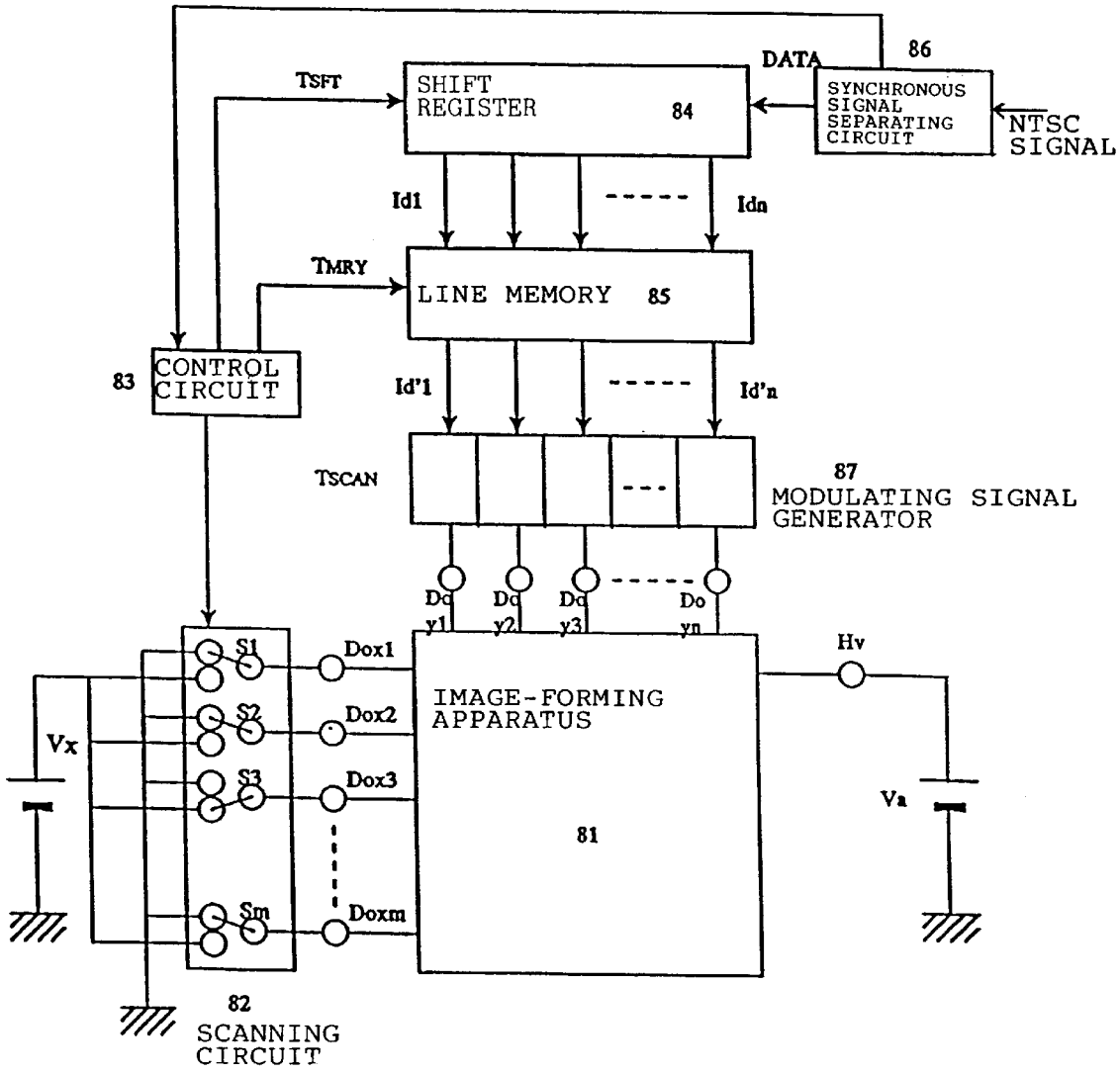
FIG. 6 is a block diagram of a driving circuit for television display.

FIG. 6 is a block diagram of a driving circuit for performing television display based on a television signal of an NTSC system by the above image-forming apparatus. In FIG. 6, reference numerals 81, 82, 83 and 84 respectively designate an image-forming apparatus, a scanning circuit, a control circuit and a shift register. Reference numerals 85, 86 and 87 respectively designate a line memory, a synchronous signal separating circuit and a modulating signal generator. Vx and Va are direct current voltage sources.

The image-forming apparatus 81 is connected to an external electric circuit through terminals Dox1 to Doxm, terminals Doy1 to Doyn and a high voltage terminal Hv. A scanning signal for sequentially, one row (N devices) at a time, operating the electron source arranged within the image-forming apparatus, i.e., a group of surface conduction type electron-emitting devices matrix-wired in a matrix shape of M-rows and N-columns is applied to the terminals Dox1 to Doxm.

A modulating signal for controlling an output electron beam of each of the surface conduction type electron-emitting devices in one row selected by the above scanning signal is applied to the terminals Doy1 to Doyn. For example, a direct current voltage of 10 Kv is supplied from the direct current voltage source Va to the high voltage terminal Hv. This direct current voltage is an accelerating voltage for giving energy sufficient to excite the phosphors to the electron beam emitted from the surface conduction type electron-emitting device.

The scanning circuit 82 will be explained. This circuit has M switching elements therein. These switching elements are typically shown by S1 to Sm in FIG. 6. Each of the switching elements selects one of an output voltage of the direct current voltage source Vx or 0 V (ground level), and is electrically connected to the terminals Dox1 to Doxm of the image-forming apparatus 81. Each of the switching elements S1 to Sm is operated on the basis of a control signal Tscan outputted from the control circuit 83. For example, these switching elements can be constructed by combining switching elements such as FETs.

In the case of this example, the direct current voltage source Vx is set to output a constant voltage such that a driving voltage applied to an unscanned device is equal to or lower than an electron emitting threshold voltage on the basis of characteristics of the surface conduction type electron-emitting device.

The control circuit 83 has a function for matching an operation of each portion so as to perform suitable display on the basis of an image signal inputted from the exterior. The control circuit 83 generates each of control signals of Tscan, Tsft and Tmry with respect to each portion on the basis of a synchronous signal Tsync sent from the synchronous signal separating circuit 86.

The synchronous signal separating circuit 86 is a circuit for separating a synchronous signal component and a luminance signal component from a television signal of an NTSC system inputted from the exterior, and can be constructed by using a general frequency separation (filter) circuit, etc. The synchronous signal separated by the synchronous signal separating circuit 86 is constructed by a vertical synchronous signal and a horizontal synchronous signal. However, the synchronous signal is here illustrated as the Tsync signal for convenience of the explanation. The luminance signal component of an image separated from the above television signal is set to a DATA signal for convenience. This DATA signal is inputted to the shift register 84.

The shift register 84 is arranged to serial/parallel-convert the above DATA signal serially inputted in time series for each line of the image, and is operated on the basis of the control signal Tsft sent from the above control circuit 83 (namely, it can be also said that the control signal Tsft is a shift clock of the shift register 84). Data on one line of the serial/parallel converted image (corresponding to driving data of N electron-emitting devices) are outputted from the above shift register 84 as N parallel signals Id1 to Idn.

The line memory 85 is a memory device for storing the data on one line of the image only for a necessary time, and suitably stores contents from Id1 to Idn in accordance with the control signal Tmry sent from the control circuit 83. The stored contents are outputted as I'd1 to I'dn and are inputted to the modulating signal generator 87.

The modulating signal generator 87 is a signal source for suitably driving and modulating each of the surface conduction type electron-emitting devices in accordance with each of the image data I'd1 to I'dn. An output signal of the modulating signal generator 87 is applied to the surface conduction type electron-emitting devices within a display panel 81 through the terminals Doy1 to Doyn.

The electron-emitting device which is able to apply the present invention thereto has the following basic characteristics with respect to an emission electric current Ie. Namely, there is a clear threshold voltage Vth in electron emission, and an electron is emitted only when a voltage equal to or higher than the threshold voltage Vth is applied. The emission current is changed in accordance with a change in the applied voltage to the device with respect to the voltage equal to or higher than the electron emitting threshold. Accordingly, no electron is emitted when the voltage of a pulse shape is applied to this device, e.g., when a voltage equal to or lower than the electron emitting threshold is applied to this device. However, an electron beam is outputted when the voltage equal to or higher than the electron emitting threshold is applied. In this case, intensity of the output electron beam can be controlled by changing a wave height value Vm of the pulse. Further, a total amount of electric charges of the outputted electron beam can be controlled by changing a width Pw of the pulse.

Accordingly, a voltage modulating system, a pulse width modulating system, etc. can be adopted as a system for modulating the electron-emitting device in accordance with an input signal. When the voltage modulating system is embodied, it is possible to use a circuit of the voltage modulating system as the modulating signal generator 87 in which the voltage pulse of a constant length is generated and the wave height value of the pulse is suitably modulated in accordance with inputted data.

When the pulse width modulating system is embodied, it is possible to use a circuit of the pulse width modulating system as the modulating signal generator 87 in which the voltage pulse of a constant wave height value is generated and the width of the voltage pulse is suitably modulated in accordance with inputted data. A digital signal system and an analog signal system can be adopted in the shift register 84 and the line memory 85. This is because these systems are sufficient if an image signal is serial/parallel-converted and stored at a predetermined speed.

When the digital signal is used, it is necessary to change an output signal DATA of the synchronous signal separating circuit 86 to a digital signal. In this case, it is sufficient to arrange an A/D converter in an output portion of the synchronous signal separating circuit 86. In association with this, circuits used in the modulating signal generator 87 are slightly different from each other according to whether an output signal of the line memory 85 is a digital signal or an analog signal. Namely, in the case of the voltage modulating system using the digital signal, for example, a D/A converting circuit is used in the modulating signal generator 87 and an amplifying circuit, etc. are added in accordance with necessity. In the case of the pulse width modulating system, the modulating signal generator 87 uses a circuit constructed by combining e.g., an oscillator operated at high speed, a counter for counting the number of waves outputted from the oscillator and a comparator for comparing an output value of the counter and an output value of the above memory. An amplifier for amplifying the voltage of a modulating signal outputted from the comparator and modulated in pulse width until a driving voltage of the surface conduction type electron-emitting device can be also added in accordance with necessity.

In the case of the voltage modulating system using the analog signal, an amplifying circuit using e.g., an operational amplifier, etc. can be adopted in the modulating signal generator 87, and a level shift circuit, etc. can be also added in accordance with necessity. In the case of the pulse width modulating system, for example, a voltage control type oscillating circuit (VOC) can be adopted, and an amplifier for amplifying voltage until the driving voltage of the surface conduction type electron-emitting device can be also added in accordance with necessity.

In the image-forming apparatus of the present invention able to be constructed in this way, electrons are emitted by applying a voltage to each electron-emitting device through the terminals Dox1 to Doxm and Doy1 to Doyn outside the container. A high voltage is applied to the metal back 8 or an unillustrated transparent electrode through the high voltage terminal Hv so that the electron beam is accelerated. The accelerated electrons collide with the fluorescent film 7 so that light is emitted and an image is formed.

The construction of the image-forming apparatus described here is one example of the image-forming apparatus to which the present invention can be applied. Accordingly, this construction can be variously modified on the basis of the technical idea of the present invention. The input signal is used in the NTSC system, but is not limited to the NTSC system. For example, PAL and SECAM systems, and a TV signal system (e.g., a commercial quality TV system as well as a MUSE system) constructed by scanning lines larger than those in the PAL and SECAM systems, etc. can be also adopted. The image-forming apparatus of the present invention can be also used as a display unit of television broadcast, a display unit of a television conference system, a computer, etc., an image-forming apparatus as an optical printer constructed by using a photosensitive drum, etc.

The embodiment modes of the present invention have been explained above. In the conventional case, when frit adhesion (seal attachment) is used in a joining portion of the envelope as well as the image-forming apparatus, it is necessary to burn the joining portion in the atmosphere at about 400° C. However, in the embodiment modes of the present invention, the problems of the prior art are dissolved as follows.

(1) In the frit adhering process, a calcinating process is normally performed and a seal attaching process is then performed so that two burning processes are required. Therefore, temperature is high and much more time is required in comparison with an adhering process performed in one process at a lower temperature. Therefore, power cost is increased in the frit adhering process. Such problems of the prior art can be dissolved.

(2) The image-forming apparatus using the surface conduction type electron-emitting device dissolves the problem of the prior art in which there is a case in which a reduction in luminance and life shortening are caused by characteristic deterioration, i.e., a reduction in an electron emission current due to heat as adhering temperature is increased when the frit adhesion (seal attachment) is performed after forming and activation are performed in advance.

(3) The present invention also dissolves the problem of the prior art of reducing gettering effects in a certain case since the oxidation of a getter material, etc. are advanced at a high temperature of about 400° C. when a getter is used.

Namely, the present invention realizes the adhering process at a temperature lower than about 400° C. required in the frit adhering (seal attachment) process, and reduces power consumption in a manufacturing process. Further, the envelope manufactured by the manufacturing method of the present invention has sufficient getter effects. Further, in the image-forming apparatus having this envelope, the reduction in luminance and the life shortening are further reduced and display quality is high.

The present invention will next be explained further in detail by giving preferable embodiments. However, the present invention is not limited to these embodiments, but includes replacement of each element and a change in design within the scope in which the object of the present invention is achieved.

[Embodiment 1]

An image-forming apparatus of this embodiment has a construction similar to that typically shown in FIG. 1. Reference numeral 1 designates an electron source in which plural electron-emitting devices are arranged on a substrate and suitable wiring is formed. Reference numerals 2, 3 and 4 respectively designate a rear plate, an outer frame and a face plate. As shown in FIG. 2 as a cross-sectional view taken along the line C–C' of FIG. 1, reference numerals 9 and 14 respectively designate an adhesive and a sealant. The rear plate 2 and the face plate 4 are joined to each other in a joining portion to the outer frame 3.

In the electron source 1 of the image-forming apparatus of this embodiment, plural (240 rows×720 columns) surface conduction type electron-emitting devices are arranged on the substrate in simple matrix wiring.

Figure 7:
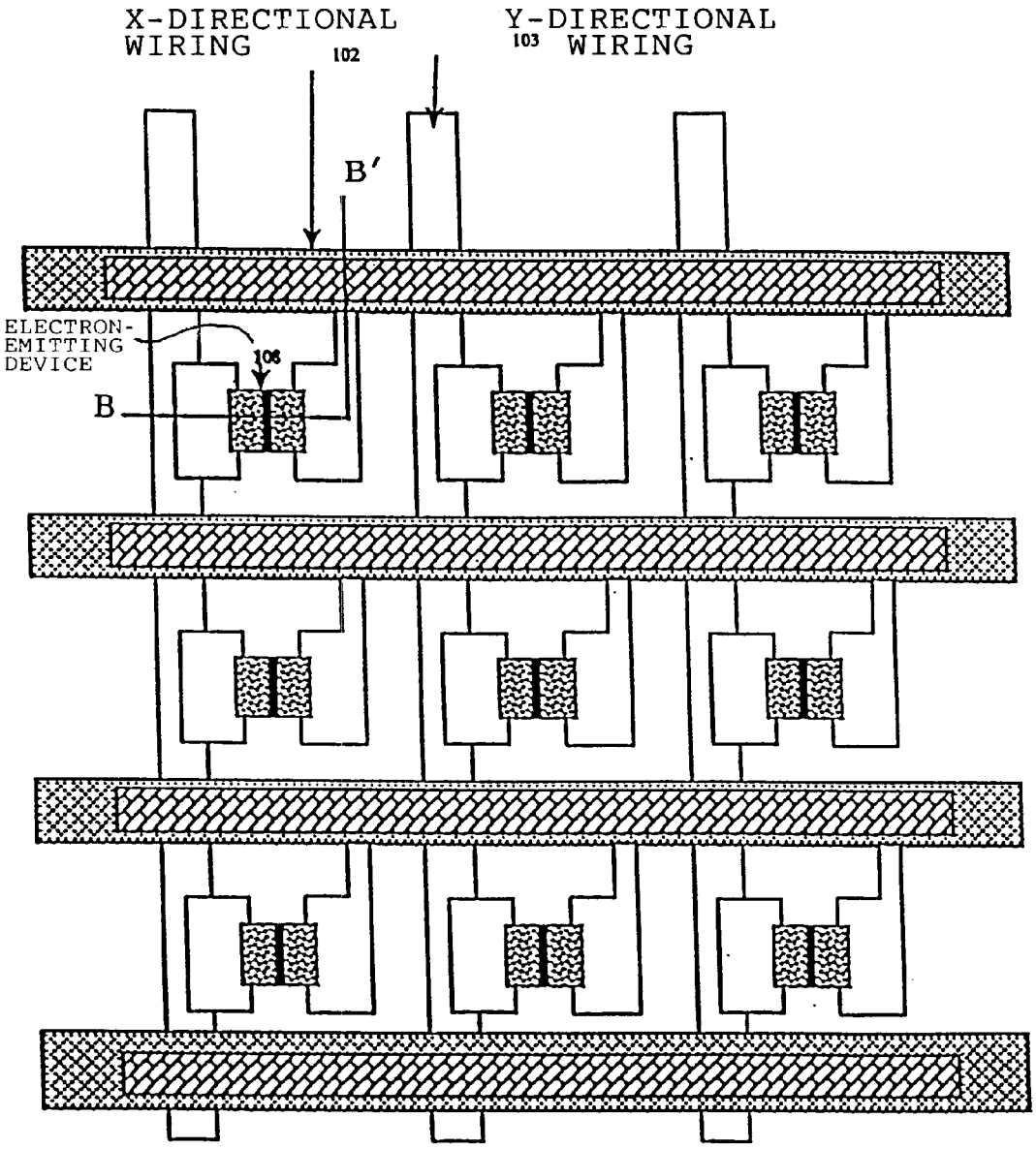
FIG. 7 is a plan view of one portion of the electron source.
Figure 8:
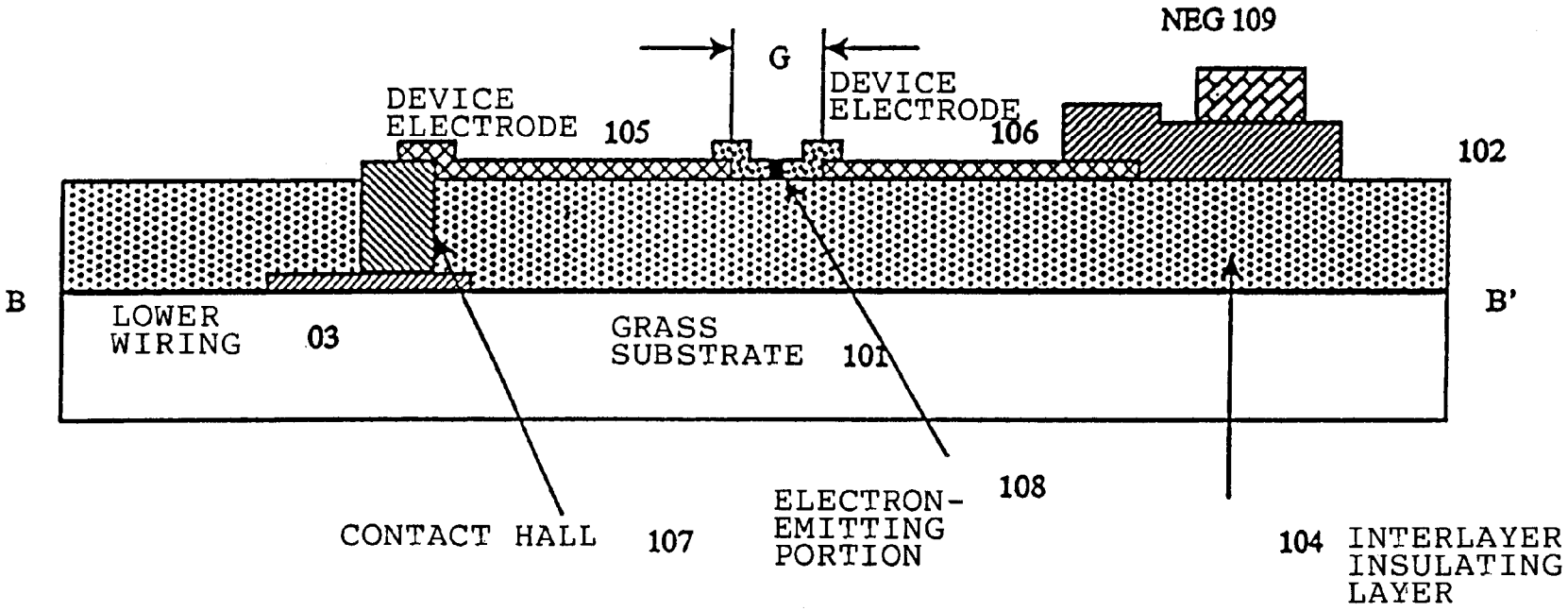
FIG. 8 is a cross-sectional view taken along the line B–B' of FIG. 7.

FIG. 7 is a partial plan view of the electron source 1. FIG. 8 is a cross-sectional view taken along the line B–B' of FIG. 7. In FIGS. 7 and 8, the same reference numerals designate the same members. Reference numerals 101, 102 and 103 respectively designate an electron source substrate, X-directional wiring (upper wiring) corresponding to Doxm of FIG. 1, and Y-directional wiring (lower wiring) corresponding to Doyn of FIG. 1. Reference numerals 108, 105 and 106 respectively designate an electroconductive film including an electron emitting portion, a device electrode and a device electrode. Reference numerals 104 and 107 respectively designate an interlayer insulating layer and a contact hole for electrically connecting the device electrode 105 and the lower wiring 103.

Figure 9:
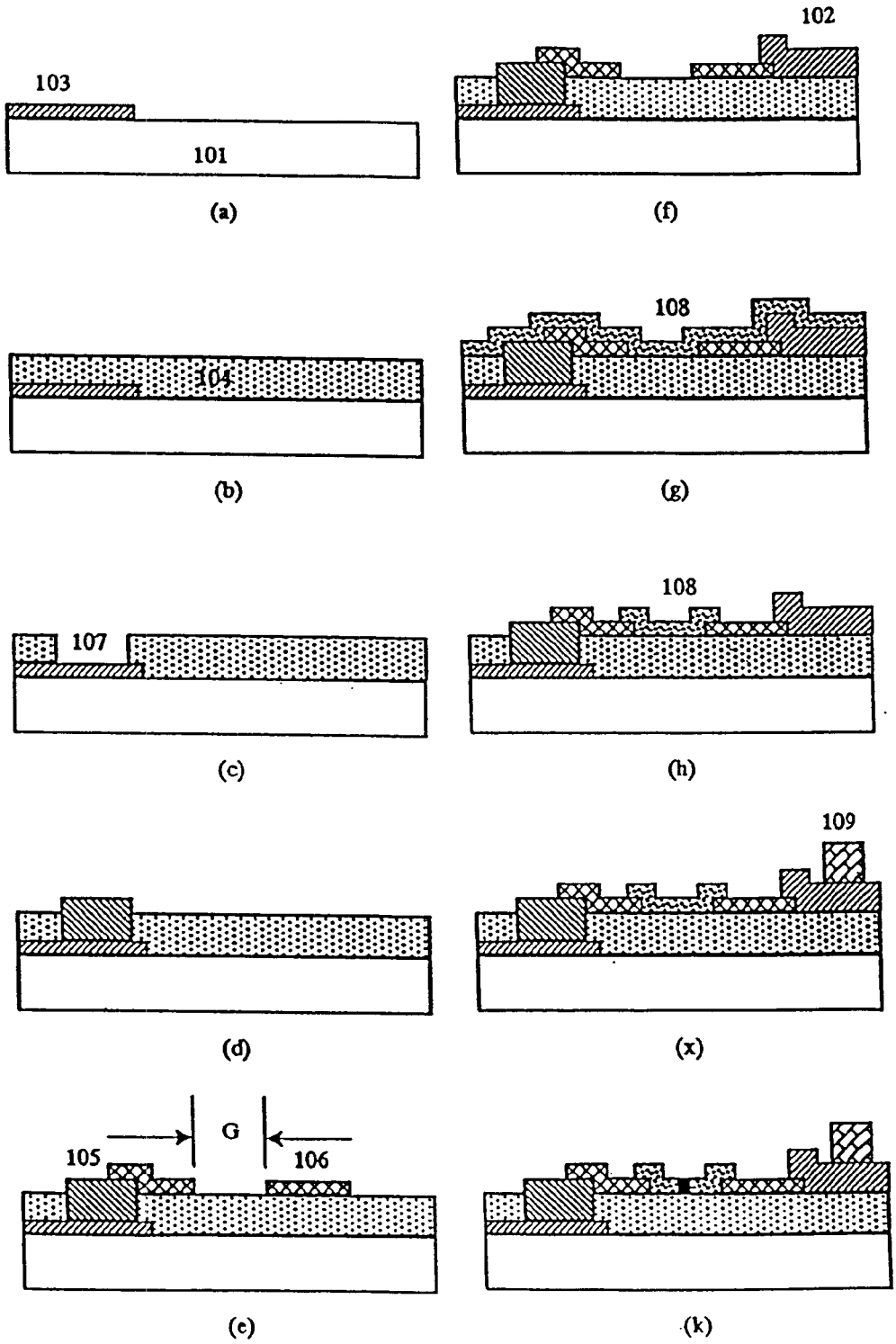
FIG. 9 is a manufacturing process view of the image-forming apparatus of Embodiment 1.

FIG. 9 is a manufacturing process view of the image-forming apparatus of this embodiment.

Process-a

The substrate 1 is sufficiently cleaned by using a detergent, pure water and an organic solvent. A silicon oxide film having a thickness of 0.5 $\mu$m is formed on this substrate 1 by a sputtering method so that an electron source substrate 1 is formed. This electron source substrate 1 is rotation-coated with photoresist (AZ1370 manufactured by Hoechst) by a spinner and is baked. Thereafter, a photomask image is exposed and developed so that a resist pattern of the lower wiring 103 is formed. Further, Cr of 5 nm in thickness and Au of 600 nm in thickness are sequentially laminated by vacuum evaporation. Thereafter, an unnecessary portion of an Au/Cr deposited film is removed by the lift-off so that the lower wiring 103 is formed in a predetermined desirable shape ((a) of FIG. 9).

Process-b

An interlayer insulating film 104 constructed by a silicon oxide film having a thickness of 1.0 $\mu$m is next deposited by an RF sputtering method ((b) of FIG. 9).

Process-c

A photoresist pattern for forming a contact hole 107 is made in the silicon oxide film deposited in the above process b. The interlayer insulating layer 104 is etched with this photoresist pattern as a mask so that the contact hole 107 is formed. The etching is reactive ion etching (RIE) using $CF_4$ and $H_2$ gas ((c) of FIG. 9).

Process-d

A pattern for coating the photoresist is formed except for a portion of the contact hole 107, and Ti of 5 nm in thickness and Au of 500 nm in thickness are sequentially deposited by the vacuum evaporation. An unnecessary portion of the deposited film is removed by the lift-off so that the contact hole 107 is buried ((d) of FIG. 9).

Process-e

Thereafter, a pattern to be a device electrode 105 and a gap G between device electrodes is formed by photoresist (RD-2000N-41 manufactured by HITACHI KASEI), and Ti of 5 nm in thickness and Ni of 100 nm in thickness are sequentially deposited by the vacuum evaporation method. The photoresist pattern is dissolved by an organic solvent and lift-off of the Ni/Ti deposited film is performed, and the device electrode gap G is set to 3 $\mu$m and the width of the device electrode is set to 300 $\mu$m, and the device electrodes 105, 106 are formed ((e) of FIG. 9).

Process-f

A photoresist pattern of upper wiring 102 is formed on the device electrodes 105, 106. Thereafter, Ti of 5 nm in thickness and Au of 500 nm in thickness are sequentially deposited by the vacuum evaporation. An unnecessary portion of the deposited film is removed by the lift-off so that the upper wiring 102 having a predetermined desirable shape and 400 $\mu$m in width is formed ((f) of FIG. 9).

Process-g

A Cr film 1019 of 100 nm in thickness is deposited and patterned by the vacuum evaporation, and is rotation-coated with a solution (ccp4230 manufactured by OKUNO SEIYAKU) of Pd amine complex by a spinner. Heating and burning operations are then performed for ten minutes at 300° C. An electroconductive film 108 for forming the electron emitting portion thus formed and constructed by fine particles made of Pd as a main element has a thickness of 8.5 nm and of $3.9\times10^4$ Ω/□in sheet resistance value.

Here, the fine particle film is a film in which plural fine particles are gathered. A fine structure of this film includes a state in which the fine particles are individually scattered and arranged, and also includes a state in which the fine particles are adjacent to each other or are overlapped (including an island-like state). Further, a particle diameter of this structure is the diameter of a fine particle having a particle shape recognizable in the above state ((g) of FIG. 9).

Process-h

The Cr film 1019 and the electroconductive film 108 for forming the electron emitting portion after burning are etched by an acid etchant, and are formed in a predetermined desirable shape ((h) of FIG. 9). Thus, the electroconductive film 108 for forming plural electron emitting portions, for example, the one having 240 rows×720 columns, is connected to the simple matrix constructed by the upper wiring 102 and the lower wiring 103 on the electron source substrate 101 by the above processes.

Process-i

Next, the face plate 4 shown in FIG. 1 is made as follows. The glass substrate 6 is sufficiently cleaned by using a detergent, pure water and an organic solvent. ITO of 0.1 $\mu$m in thickness is deposited on this glass substrate 6 by the sputtering method so that a transparent electrode 1011 is formed. Subsequently, a fluorescent film 7 is coated by a printing method, and smoothing processing normally called "filming" is performed on a surface of the fluorescent film 7 so that a phosphor portion is formed. The fluorescent film 7 is set to a fluorescent film shown in (a) of FIG. 6, in which phosphors (R, G, B) 13 of a stripe shape and a black member (black stripe) 12 are alternately arranged. Further, a metal back 8 constructed by an Al thin film and having a thickness of 0.1 $\mu$m is formed on the fluorescent film 7 by the sputtering method.

Process-j

The envelope 5 shown in FIG. 1 is next made as follows.

After the electron source 1 made by the above processes is fixed to the rear plate 2, the outer frame 3, the above face plate 4 and the electron source 1 are combined with each other, and the lower wiring 103 and the upper wiring 102 of the electron source 1 are respectively connected to a terminal 10 for row selection and a signal input terminal 11. The electron source 1 and the face plate 4 are strictly adjusted in position, and are adhered to each other so that the envelope 5 is formed.

In the joining, In wire is set to a sealant 14 and is molded in an arbitrary shape and is heated at a temperature equal to or higher than 160° C. so that In is softened and press-attached. After the sealant is sealed in a temperature drop process, a peripheral portion of the sealant is coated with an adhesive (product name 3715 manufactured by THREE BOND) of a paste shape having zirconia and silica as principal components as the adhesive 9 in a shape of the outer frame by a dispenser. Moisture is evaporated at a temperature equal to or lower than 100° C. and the adhesive 9 is adhered at a temperature of about 150° C. An internal structure such as the electron source 1 is also similarly fixed. When the rear plate 2 and the face plate 4 are arranged, a ring-shaped getter 16 as an evaporation type getter having Ba as a principal component is simultaneously arranged outside an image display area.

Figure 10:
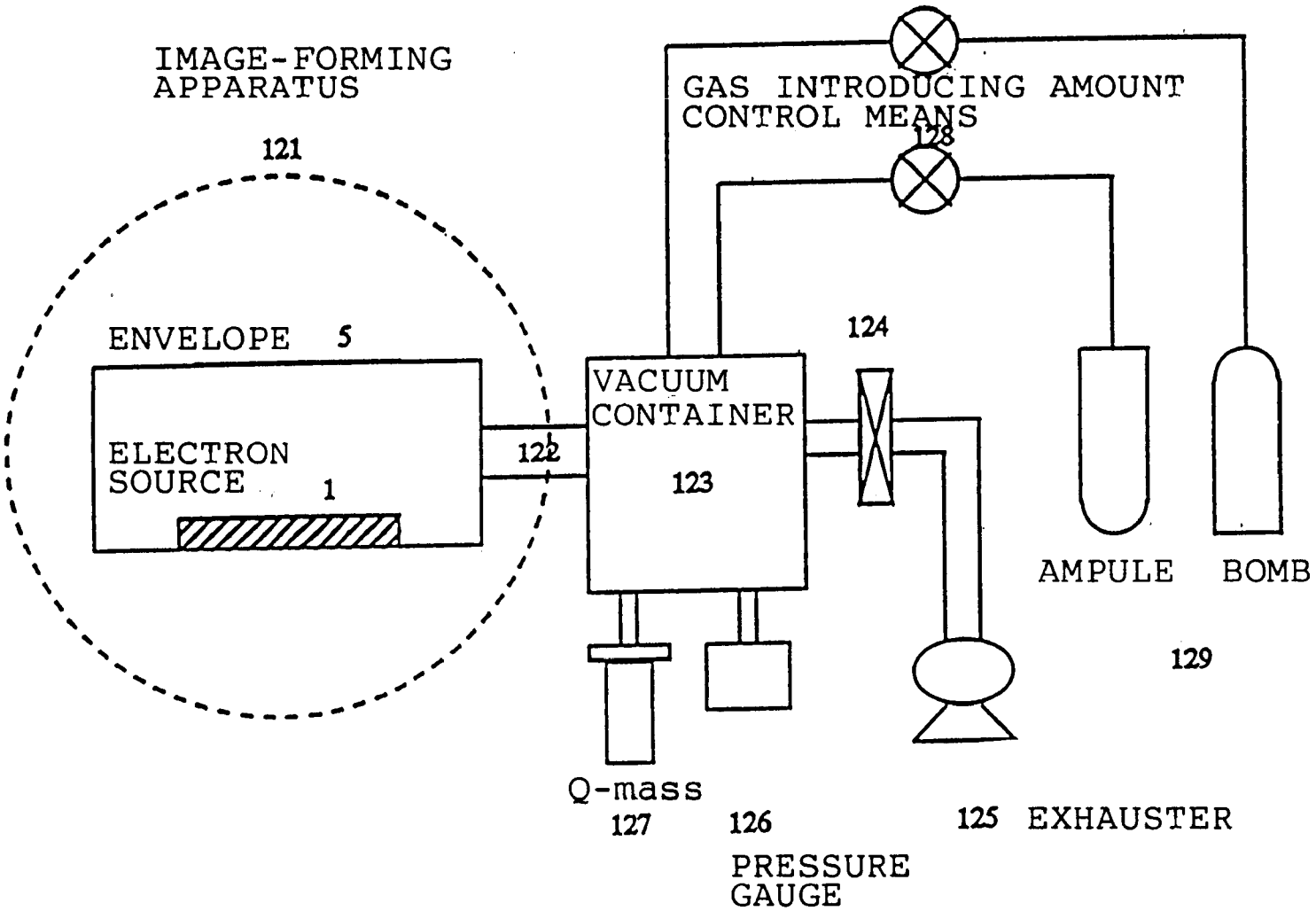
FIG. 10 is a typical view of a vacuum device used in a forming process and an activating process.

FIG. 10 is a conceptual view of a vacuum device used in a subsequent process.

An image-forming apparatus 121 is connected to a vacuum container 123 through an exhaust pipe 122. An exhauster 125 is connected to the vacuum container 123, and a gate valve 124 is arranged between the vacuum container 123 and the exhauster 125. A pressure gauge 126 and a quadrupole mass spectrometer (Q-mass) 127 are attached to the vacuum container 123 so as to monitor the internal pressure and a partial pressure of each of the residual gasses. It is difficult to directly measure the pressure within the envelope 5 and the partial pressure. Accordingly, the pressure of the vacuum container 123 and the partial pressure are measured and these pressure values are considered as the pressures within the envelope 5.

The exhauster 125 is an exhauster for a super high vacuum constructed by a sorption pump and an ion pump. Plural gas introducing devices are connected to the vacuum container 123 and can introduce a substance accumulated to a substance source 129. A bomb or an ampul is filled with the introducing substance in accordance with its kind, and an introducing amount can be controlled by a gas introducing amount control means 128. A needle valve, a mass flow controller, etc. are used in the gas introducing amount control means 128 in accordance with the kind of the introducing substance, a flow rate, a required control accuracy, etc. In this embodiment, benzonitrile stored in a glass ampul is used as the substance source 129, and a slow leak valve is used as the gas introducing amount control means 128. Subsequent processes are performed by using the above vacuum processor.

Process-k

The interior of the envelope 5 is exhausted and the pressure is set to be equal to or lower than $1\times10^{-3}$ Pa. Further, the following operation (called forming) for forming the electron emitting portions is performed with respect to the above electroconductive film 108 ((k) of FIG. 9) for forming plural electron emitting portions and arranged on the electron source substrate 101.

Figure 11:
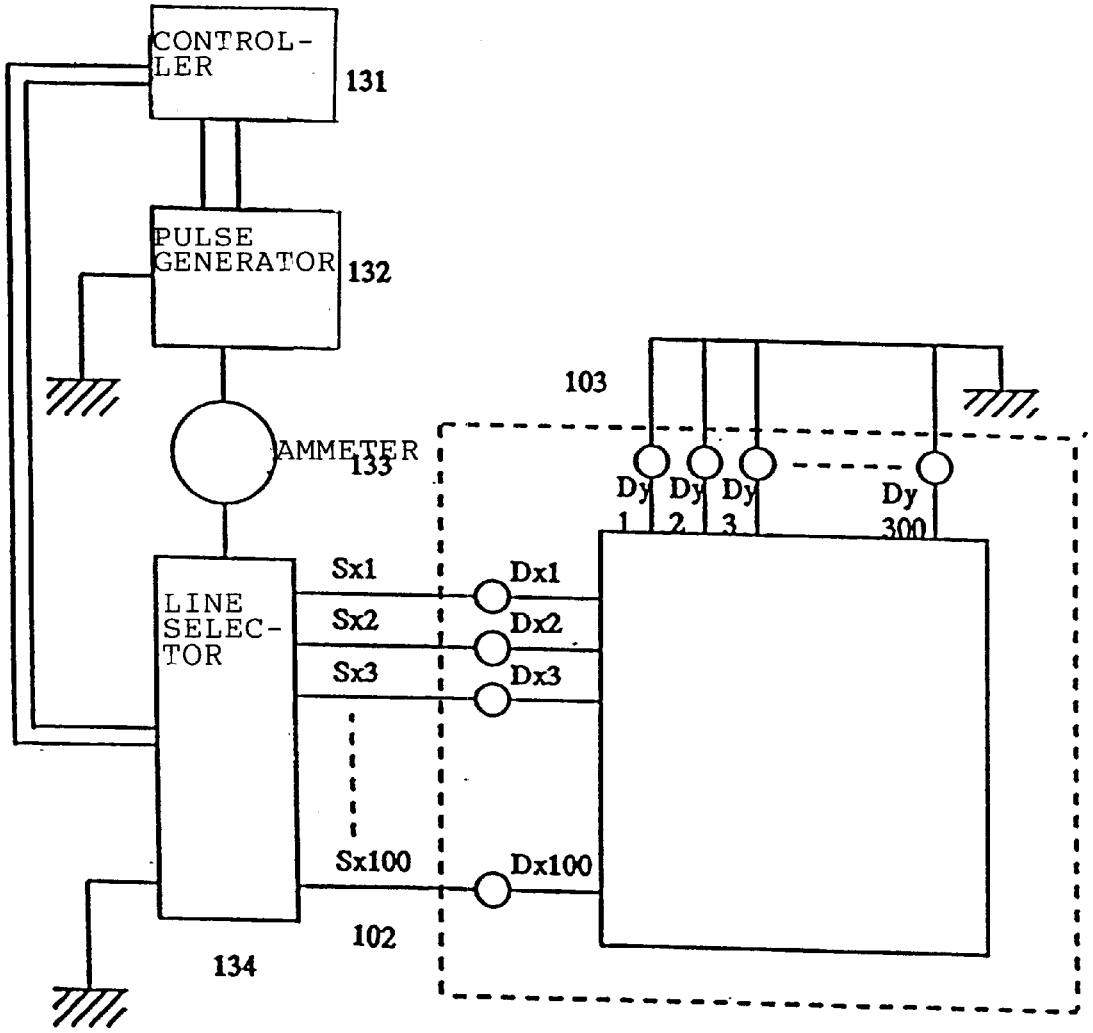
FIG. 11 is a typical view showing a connection method for the forming and activating processes in the image-forming apparatus of the present invention.

As shown in FIG. 11, Y-directional wiring 103 is commonly connected to the ground. A controller 131 controls the operations of a pulse generator 132 and a line selector 134. Reference numeral 133 designates an ammeter. One line is selected from the X-directional wiring 102 by the line selector 134, and a pulse voltage is applied to this one line. The forming operation is performed with respect to device rows in the X-direction every one row (300 devices).

Figure 12:
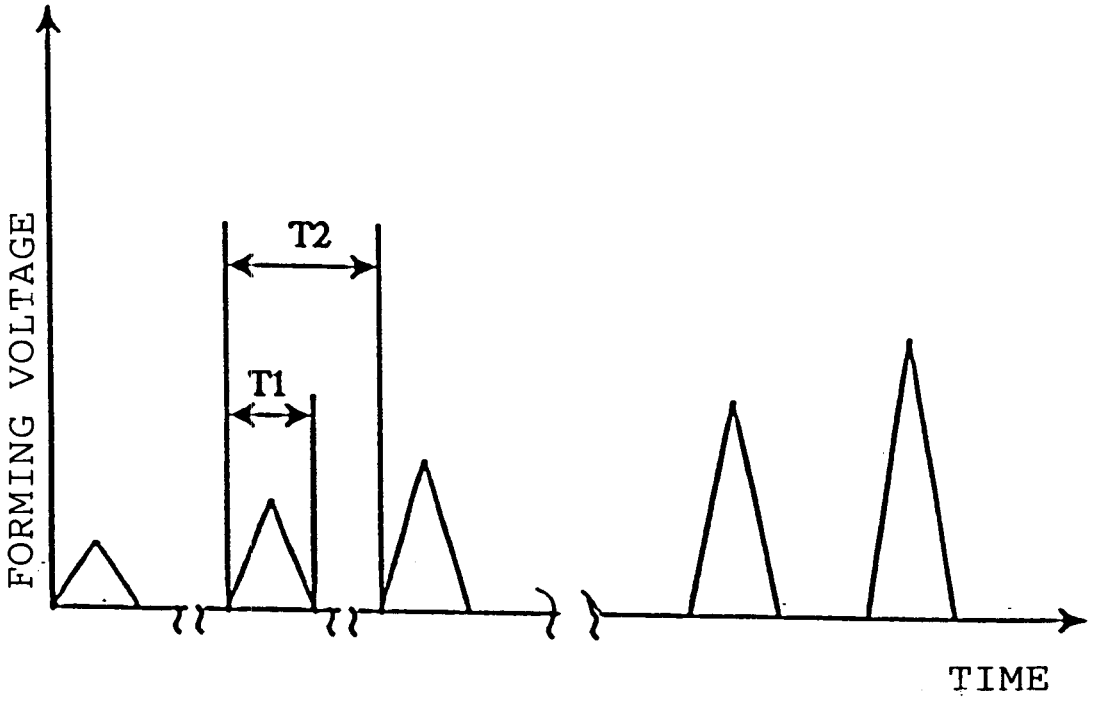
FIG. 12 is a wave form chart of a pulse applied in the forming process.

FIG. 12 is a wave form chart of an applied pulse.

The wave height value of a triangular wave pulse in the applied pulse is gradually raised on a time axis. Pulse width T1=1 msec and pulse interval T2=10 msec are set. A rectangular wave pulse having a wave height value of 0.1 V is inserted between triangular wave pulses, and a resistance value in each row is measured by measuring an electric current. When the resistance value exceeds 3.3 kΩ (1 MΩ per one device), the forming operation in this row is terminated and the forming operation in the next row is started. The forming operation is performed with respect to all the rows. Thus, the forming of all the above electroconductive films (the electroconductive firms 108 for forming the electron-emitting portions) is completed. Thus, the electron-emitting portion is formed in each electroconductive film, and the electron source 1 having the plural surface conduction type electron-emitting devices wired in simple matrix is made.

Process-l

Benzonitrile is introduced into the vacuum container 123 and the pressure is adjusted to be $1.3\times10^{-3}$ Pa. While a device If is measured, a pulse is applied to the above electron source 1 and activation operation of each electron-emitting device is performed.

Figure 13:
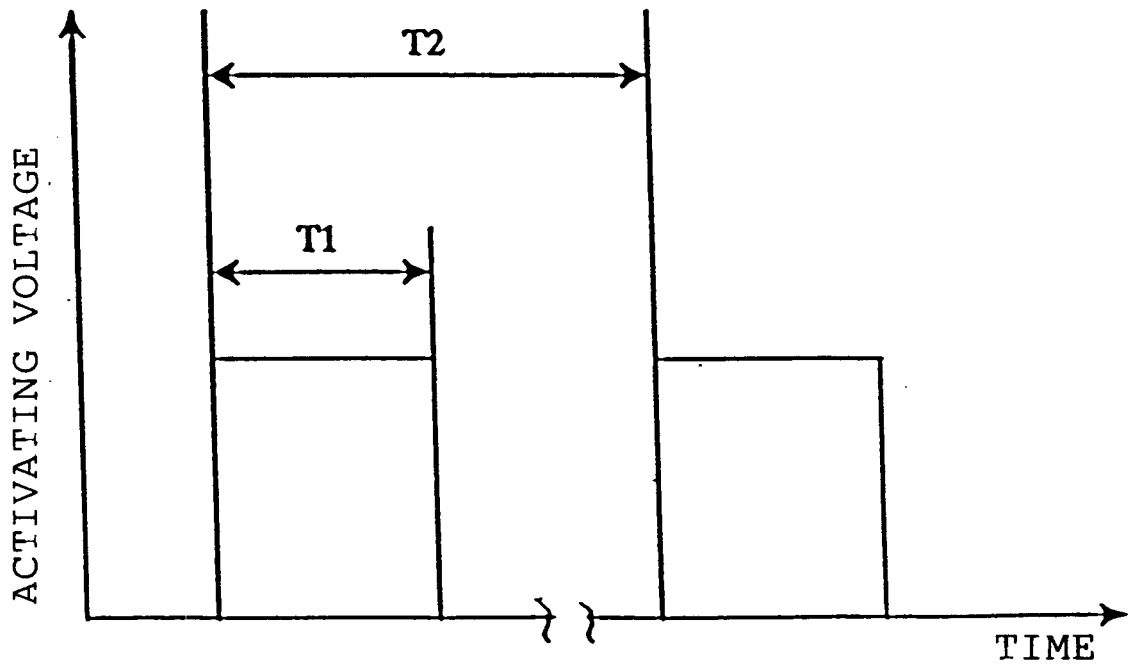
FIG. 13 is a wave form chart of a pulse applied in the activating process.

FIG. 13 is a wave form chart of the pulse generated by the pulse generator 132. As shown in FIG. 13, the pulse for activation operation is a rectangular wave, and has a wave height value of 14 V, a pulse width T1=100 μsec and a pulse interval of 167 μsec. A selecting line is sequentially switched by the line selector 134 from D×1 to D×100 every 167 μsec. As a result, the rectangular wave of T1=100 μsec and T2=16.7 msec is shifted little by little in phase every row and is applied to each element row.

The ammeter 133 is used in a mode for detecting the average of an electric current value in an on-state (when the voltage is 14 V) of the rectangular wave pulse. When this current value becomes 600 Ma (2 Ma per one device), the activation operations terminated and the interior of the envelope 5 is exhausted.

Process-m

While the interior of the envelope 5 is exhausted, the image-forming apparatus 121 and the vacuum container 123 are entirely held for ten hours at 300° C. by an unillustrated heater. Benzonitrile and its decomposed substances considered to be adsorbed to inner walls of the envelope 5 and the vacuum container 123, etc. are removed by this processing. This was confirmed by an observation using Q-mass 127.

Process-n

After it is confirmed that the pressure is equal to or lower than $1.3\times10^{-5}$ Pa, the exhaust pipe is heated, sealed and cut by a burner. Subsequently, the evaporation type getter 16 of a ring shape arranged outside the image display area is flashed by high frequency heating.

The image-forming apparatus of this embodiment is made by the above processes.

[Embodiment 2]

Figure 14:
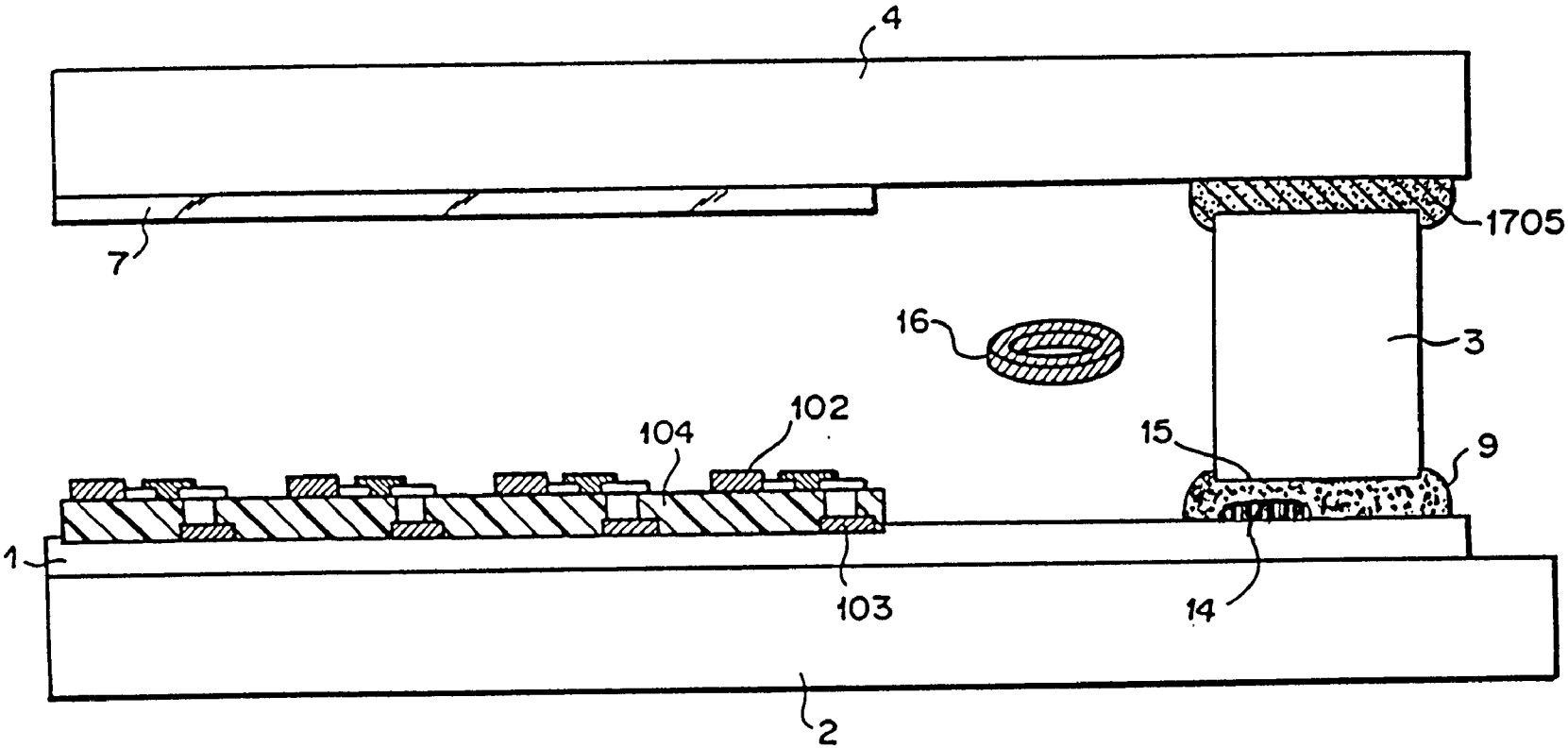
FIG. 14 is a cross-sectional view of the image-forming apparatus of Embodiment 2.

FIG. 14 is a cross-sectional view of an image-forming apparatus of this embodiment. In this embodiment, the processes of the embodiment 1 are similarly performed except that the following joining portion is used as the joining portion of the process-j in the embodiment 1, and the face plate 4 and the outer frame 3 are joined to each other by frit in advance.

An inorganic adhesive (product name 3715 manufactured by THREE BOND Co., Ltd.) of a paste shape having zirconia and silica as principal components is molded in an arbitrary shape by a dispenser, etc. Moisture is evaporated from the inorganic adhesive at a temperature equal to or lower than 100° C. A coating film 15 of In is then formed on a surface of this inorganic adhesive by the known vacuum evaporation method such as EB, sputtering, etc., and is used as a sealant of the joining portion. Next, the coating film 15 of In is softened and press-attached by heating the sealant at a temperature equal to or higher than 160° C. After the coating film 15 is sealed in a temperature drop process, a peripheral portion of the sealant 14 is coated with an adhesive of a paste shape (product name 3715 manufactured by THREE BOND Co., Ltd.) having zirconia and silica as principal components as the adhesive 9 in a shape of the outer frame by the dispenser. Moisture is evaporated at a temperature equal to or lower than 100° C., and the adhesive 9 is adhered at about 150° C.

Similar to the embodiment 1, the image-forming apparatus is made except for the process-j.

[Embodiment 3]

Figure 15:
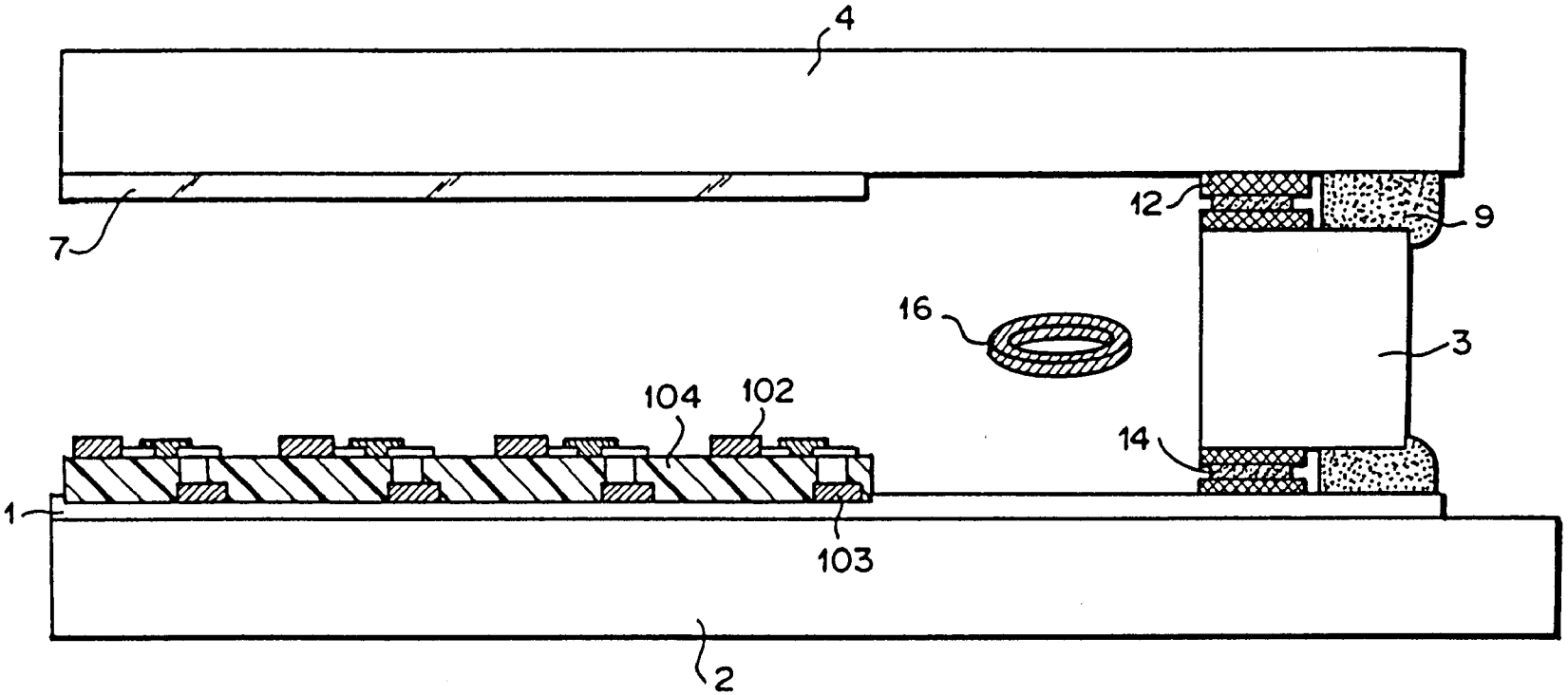
FIG. 15 is a cross-sectional view of the image-forming apparatus of Embodiment 3.

FIG. 15 is a cross-sectional view of an image-forming apparatus of this embodiment. In this embodiment, processes similar to those in the embodiment 1 are performed except that indium (In) as a surface processing layer 12 constituting a surface processing material is evaporated in a contact portion of the rear plate 2, the face plate 4 and the sealant of the outer frame 3 by the known vacuum evaporation method such as EB, sputtering, etc., and the following joining portion is used as the joining portion of the process-j of the embodiment 1.

In the joining portion of this embodiment, Al is used as the sealant, and a polymeric thermoplastic organic adhesive having polyether ketone as a principal component is used as the adhesive. Al as the sealant and the polymeric thermoplastic organic adhesive of a sheet shape having polyether ketone as a principal component as the adhensive are molded in an arbitrary shape, and are heated until a temperature equal to or higher than 330° C. The adhesive is thus softened, press-attached and sealed. The adhesive is then adhered by hardening the adhesive in a temperature drop process. Thus, the above conditions 1 to 6 can be satisfied.

Similar to the embodiment 1, the image-forming apparatus is made except for the process-j.

[Embodiment 4]

In this embodiment, processes similar to those in the embodiment 1 are performed except that the following joining portion is used as the joining portion of the process-j in the embodiment 1.

In the joining portion of this embodiment, In is used as the sealant, and each of polymeric thermoplastic adhesives 9, 14 of a paste shape having polysulfone as a principal component: product name of stay stick 301 manufactured by TECHNO ALPHA Co., Ltd. is used as the adhesive. In wire is set to the sealant 14, and is molded in an arbitrary shape and is heated at a temperature equal to or higher than 160° C. Thus, In is softened, press-attached and sealed in a temperature drop process. Thereafter, the polymeric thermoplastic adhesive 9 of a paste shape having polysulfone as a principal component: product name of stay stick 301 manufactured by TECHNO ALPHA Co., Ltd. is used as the adhesive 9, and a glass member is coated with this adhesive in an arbitrary shape by a dispenser coating method. The adhesive is defoamed and a solvent is evaporated at 150° C. Thereafter, the adhesive is heated until a heating treatment temperature reaches equal to or higher than 300° C. and press-attached. The adhesive is adhered by hardening the adhesive in the temperature drop process. Thus, the above conditions 1 to 6 can be satisfied.

Similar to the embodiment 1, the image-forming apparatus is made except for the process-j.

[Embodiment 5]

This embodiment differs from the embodiment 1 in that the forming operation and the activation operation are performed before the adhering process. In this embodiment, after the process-h of the embodiment 1 is performed, processes-k, l are performed, and processes-i, j are then performed, and processes m, n are next performed.

The image-forming apparatus of this embodiment is made by the above processes.

COMPARISON EXAMPLE 1

An image-forming apparatus similar to that in the embodiment 1 is made. However, in this comparison example, frit is used as the adhesive, and a forming process at an adhering temperature of 410° C. is performed.

A comparing evaluation of the image-forming apparatus of each of the embodiments 1 to 5 and the comparison example 1 mentioned above is carried out. In the evaluation, simple matrix driving is performed and light is emitted from an entire face of the image-forming apparatus, and a change in luminance with the passage of time is measured. As a result, initial luminances are different from each other, but the changes in luminance with the passage of time are equal to each other.

As explained above, at least two members constructed by the sealant having a seal function and the adhesive having an adhesive function in at least one of the above joining portions are used as a joining portion in the adhering process, and this adhering process is one adhering process at a heat treatment temperature equal to or lower than 330° C. Accordingly, power cost is reduced and the envelope as well as the image-forming apparatus can be provided.

In particular, in the embodiment 5, the energization forming operation and the activation operation are performed before adhesion of the envelope. There is conventionally a case in which a reduction in luminance and life shortening are caused by characteristic deterioration, i.e., a reduction in an electron-emission current due to heat when frit is adhered at 410° C. after the forming operation and the activation operation are performed. In contrast to this, the reduction in luminance and the life shortening are almost not caused in the embodiment 5. Further, the energization forming operation and the activation operation are performed within a vacuum chamber before the adhesion of the envelope. Therefore, it is easy to introduce a gas in comparison with a case after the adhesion of the envelope. Further, if there are problems in the energization forming operation and the activation operation, there is an advantage in that only a rear plate unit becomes useless instead of the envelope.

[Embodiment 6]

Figure 16:
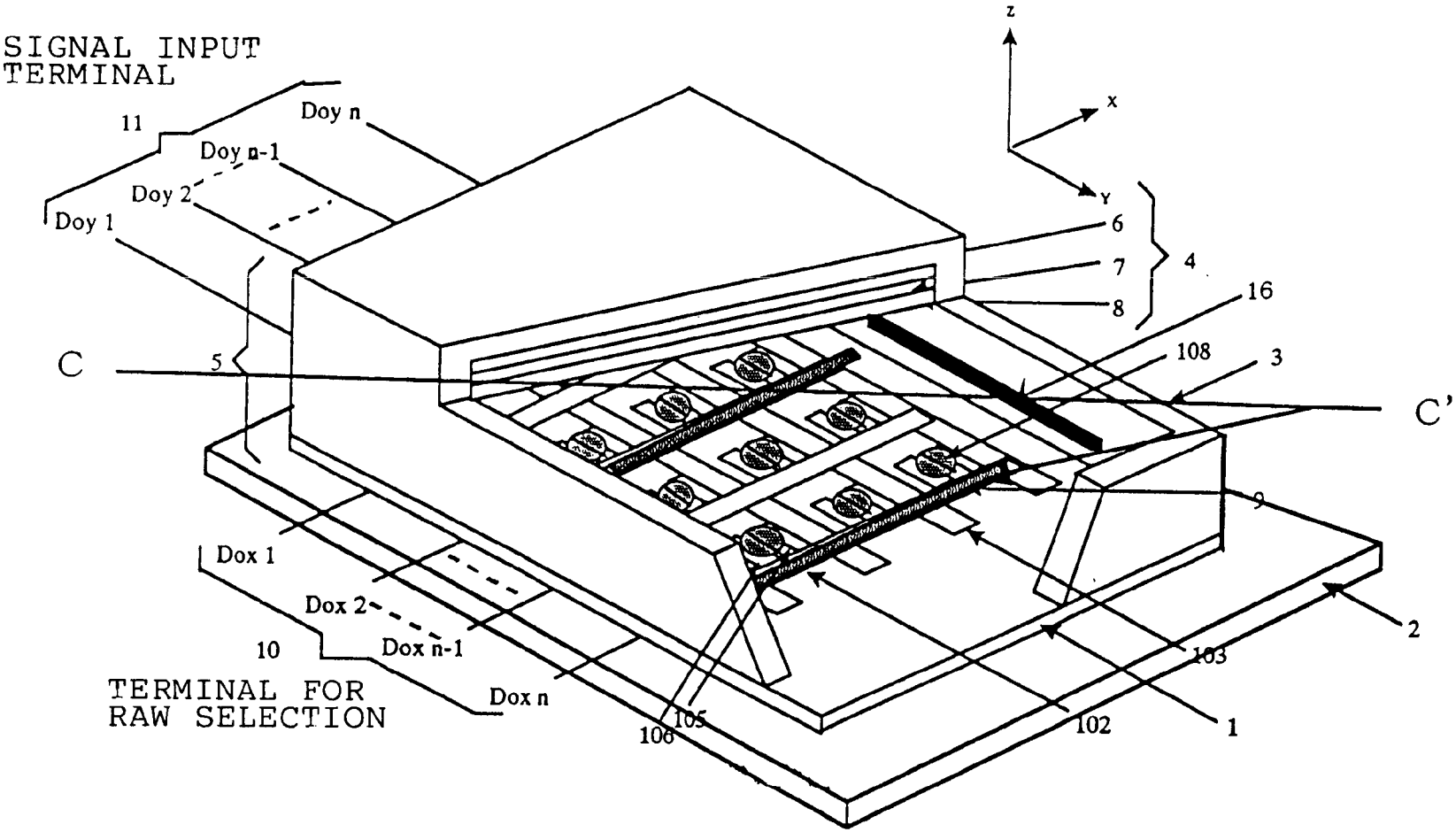
FIG. 16 is a perspective view of the image-forming apparatus of Embodiment 6.
Figure 17:
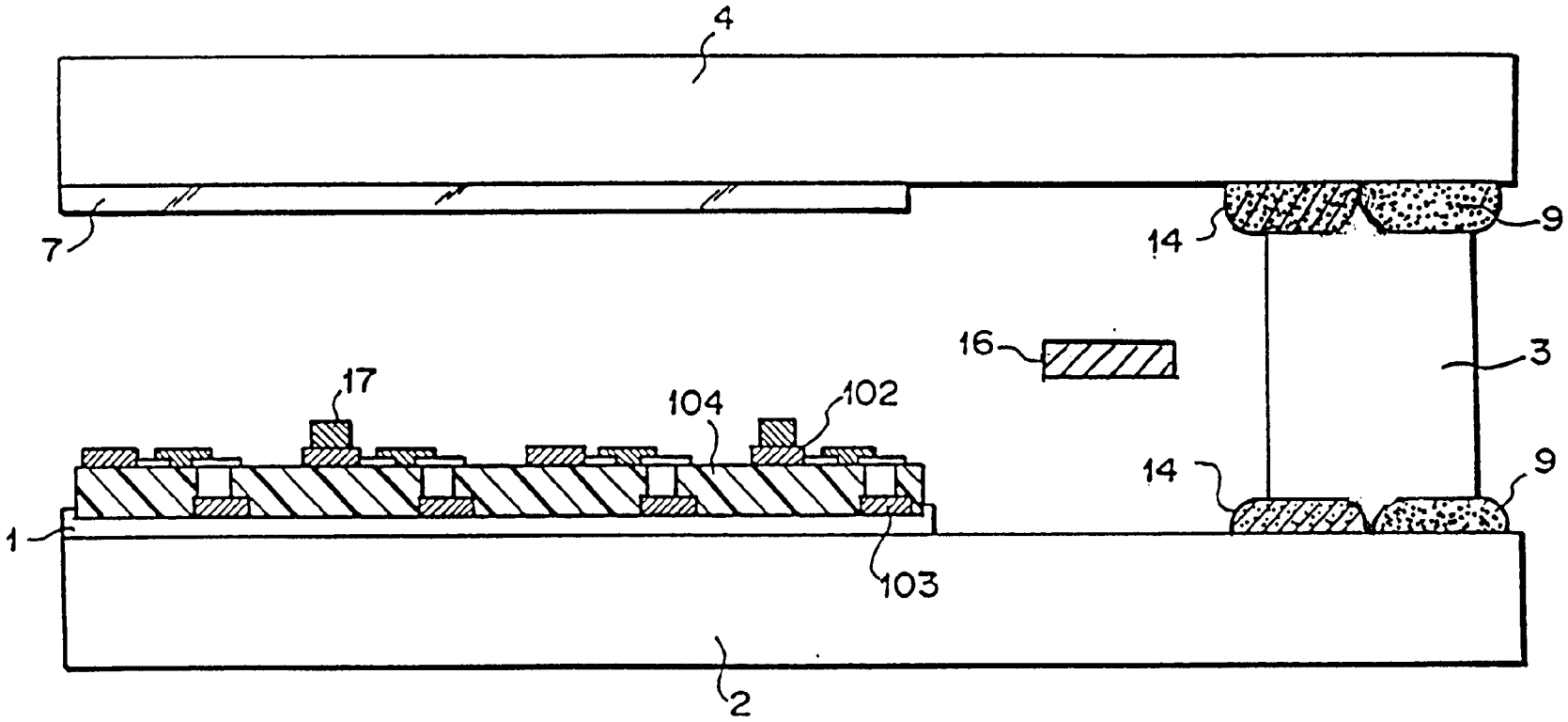
FIG. 17 is a cross-sectional view taken along the line C–C' of FIG. 16.

FIG. 16 shows a perspective view of an image-forming apparatus of this embodiment. FIG. 17 shows a cross-sectional view taken along line C–C' of FIG. 16.

This embodiment differs from the embodiment 1 in that a ribbon-shaped getter is arranged instead of a ring-shaped getter and is flashed by resistance heating, and a non-evaporation type getter is arranged within the image-forming apparatus. In this embodiment, similar to the embodiment 1, the image-forming apparatus is made except that a getter process-h is performed, and a process-x is then performed, and a process-i-n is then performed.

However, in a process-m of this embodiment, a gas is removed from the interior of the image-forming apparatus by heating/exhaust-holding of the image-forming apparatus, and activation operation of the getter is also performed.

Process-x

A getter layer 17 constructed by a Zr—V—Fe alloy is formed on the upper wiring 102 within the image display area by using a metal mask in the sputtering method. In the composition of a used sputtering target, Zr; 70%, V; 25%, and Fe; 5% (percentage by weight) are set ((x) of FIG. 8).

The electron source 1 having the getter 17 is formed by the above processes.

COMPARISON EXAMPLE 2

An image-forming apparatus similar to that in the embodiment 6 is made. However, in this comparison example, frit is used as an adhesive, and a forming process at an adhering temperature of 420° C. is performed.

A comparative evaluation of the image-forming apparatuses of the embodiment 6 and the comparison example 2 is carried out. In the evaluation, simple matrix driving is performed, and light is emitted from an entire face of the image-forming apparatus, and a change in luminance with the passage of time is measured. As a result, although initial luminances are different from each other, a getter sufficiently functions in the image-forming apparatus of the embodiment 6, and no reduction in luminance is almost caused even when the image-forming apparatus is operated for a long time. In contrast to this, in the comparison example 2, luminance is relatively gradually reduced. A degree of this reduction is approximately equal to that in the comparison example 1 in which no getter is arranged.

[Embodiment 7]

Figure 18:
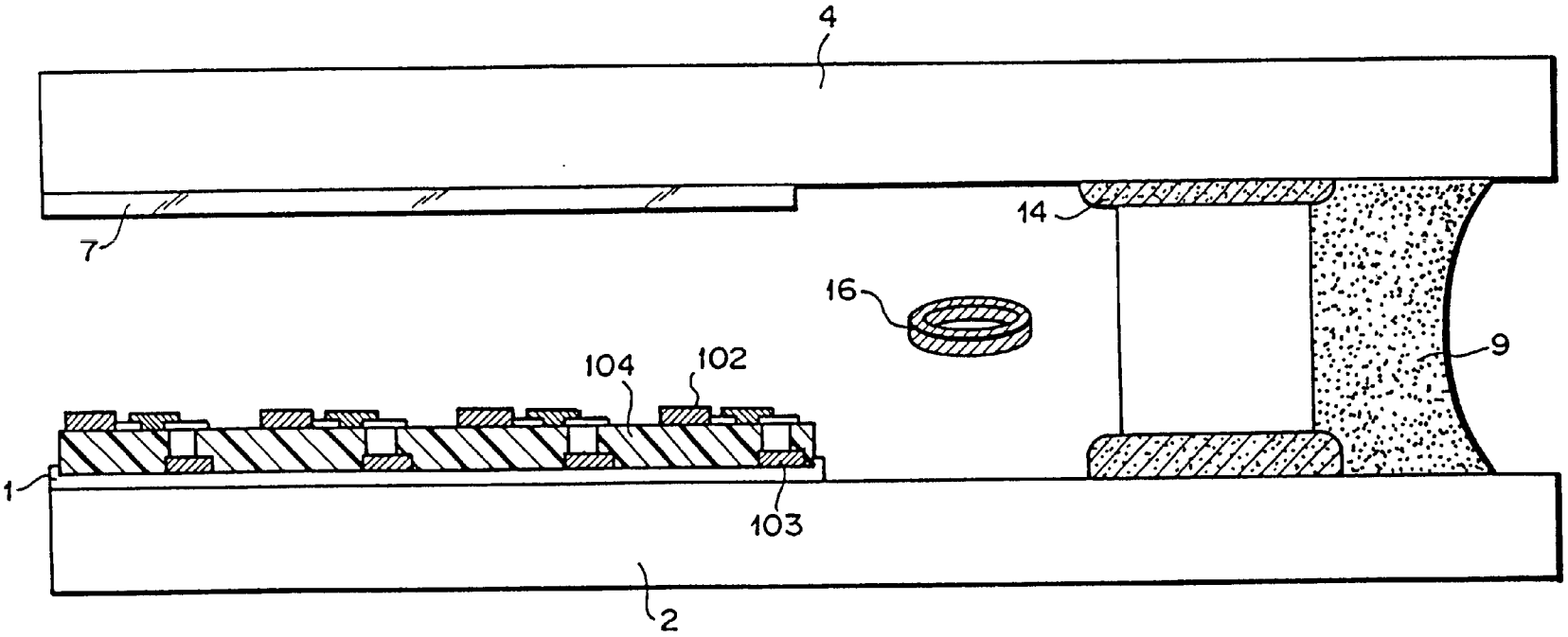
FIG. 18 is a cross-sectional view of the image-forming apparatus of Embodiment 7.
Figure 19:
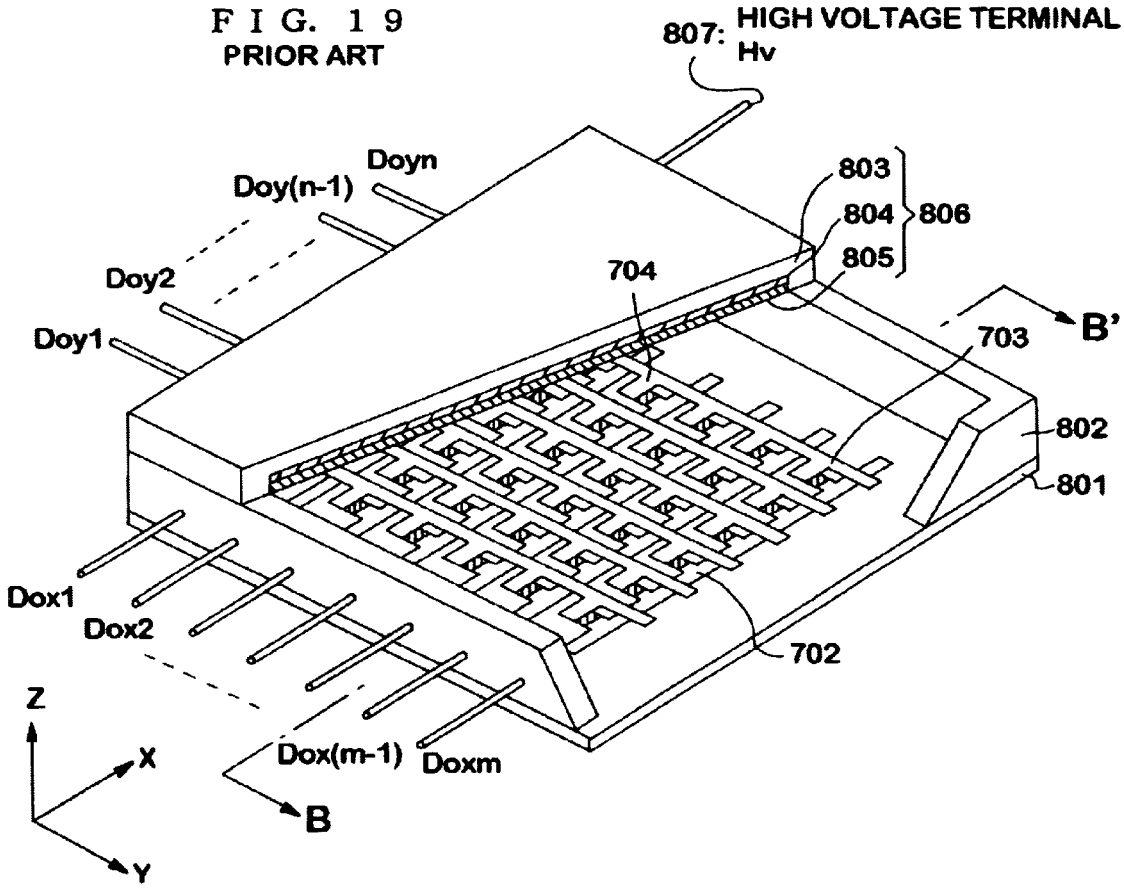
F I G. 1 9 PRIOR ART
FIG. 19 is a perspective view of a conventional image-forming apparatus.
Figure 20:
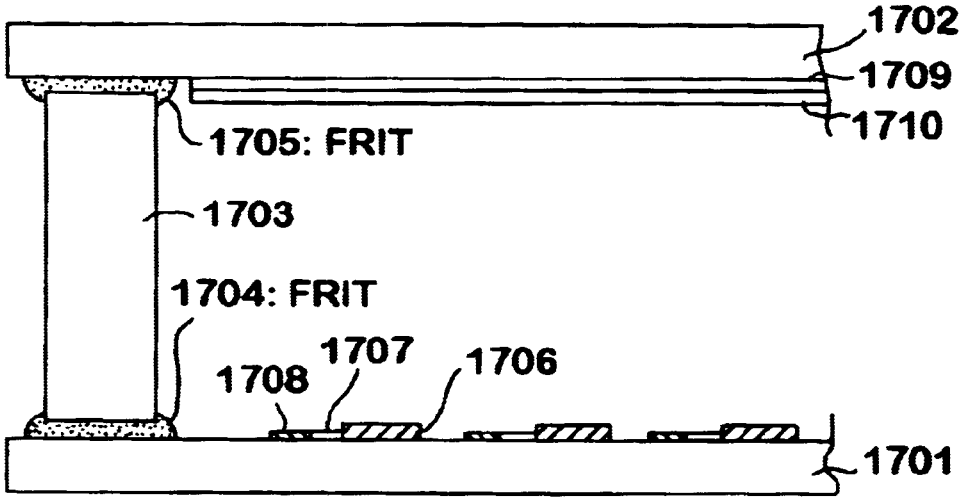
FIG. 20 PRIOR ART
FIG. 20 is a cross-sectional view taken along the line B–B' of FIG. 19.

FIG. 18 is a cross-sectional view of the image-forming apparatus of Embodiment 7 showing features of the present invention.

This embodiment relates to the process-j of the embodiment 1, and the other processes are similar to those in the embodiment 1.

In the sealant 14 of a joining portion, indium (In) wire and an In sheet are molded in an arbitrary shape and are heated at a temperature equal to or higher than 160° C. so that In is softened, and a rear plate 2 and an outer frame 3, and a face plate 4 and the outer frame 3 are respectively sealed. Thereafter, the image-forming apparatus is formed by filling an adhesive 9 between the rear plate 2 and the face plate 4 so as to cover an outer circumference of the sealant 14 of In and the outer frame 3.

The embodiments of the present invention have thus been explained.

In each of the embodiments explained above, the rear plate 2 and the face plate 3 can be adhered to each other through the outer frame 3 at a temperature equal to or lower than 400° C. The sealant used here is preferably formed by a material having a melting point equal to or lower than 400° C. For example, the sealant is formed by various kinds of alloys such as a so-called soldering material constructed by a metal of In, Sn, Pb, etc., a Pb group, an Sn group, an In group and an Au group, a low intermediate temperature soldering material of a Bi-system, an Sn—PB system, an Sn—Zn system, a Cd—Zn system and a Zn—Al system, a high temperature soldering material of a Cd system and an Sn system, etc.

In the embodiments explained above, at least two members constructed by a sealant having a seal function and an adhesive having an adhesive function in at least one of the above joining portions are used as a joining portion. Accordingly, it is possible to provide an envelope in which power consumption in a manufacturing process is reduced, and a reduction in luminance, life shortening and deterioration of the function of a getter are almost not caused. Further, when this envelope is applied to the image-forming apparatus, the reduction in luminance and the life shortening are reduced and display quality is high and the function of the getter is sufficient.

The present invention is particularly effective in the image-forming apparatus which has no electrode structure such as a control electrode, etc. between the electron source and an image-forming member. However, the present invention can be also applied to the image-forming apparatus having the control electrode, etc.

Industrial Applicability

In accordance with the invention in the present application, it is possible to obtain a suitable envelope and a suitable image-forming apparatus, and realize a manufacturing method of the suitable envelope.

What is claimed is:

1. An envelope comprising a face plate, a rear plate arranged so as to be opposite to said face plate, an outer frame arranged between said face and rear plates and surrounding a circumference, a face plate joining portion for joining said outer frame and said face plate, and a rear plate joining portion for joining said outer frame and said rear plate to each other, with one or both of said face plate joining portion and said rear plate joining portion including a sealant having a seal function and an adhesive having an adhesive function.

2. An envelope according to claim 1, characterized in that a getter is arranged within the envelope.

3. An envelope according to claim 1, characterized in that a surface of said sealant is formed by a metal.

4. An envelope according to claim 1, characterized in that said adhesive is an organic substance.

5. An envelope according to claim 1, characterized in that said adhesive is an inorganic substance.

6. An image-forming apparatus, comprising:

an envelope comprising a face plate, a rear plate arranged so as to be opposite to said face plate, an outer frame arranged between said face and rear plates and surrounding a circumference, a face plate joining portion for joining said outer frame and said face plate, and a rear plate joining portion for joining said outer frame and said rear plate to each other, with one or both of said face plate joining portion and said rear plate joining portion including a sealant having a seal function and an adhesive having an adhesive function;

an image-forming member and an electron accelerating electrode formed in said face plate; and an electron source formed in said rear plate.

7. An image-forming apparatus according to claim 6, characterized in that said electron source is a surface conduction type electron-emitting device.

8. An envelope constructed by combining plural members and airtightly maintaining an internal space with respect to the exterior, characterized in that the envelope has a joining portion airtightly joining said members to each other by a sealant having a seal function, and said airtight joining is reinforced by an adhesive having an adhesive function.

9. An envelope according to claim 8, characterized in that said adhesive is arranged such that said adhesive is in contact with said joining portion.

10. An envelope according to any one of claims 8 and 9, characterized in that said adhesive is arranged outside the internal space airtightly maintained by said sealant.

11. An envelope according to claim 10, characterized in that said sealant is formed by a material that allows to perform a seal process at a temperature equal to or lower than 400° C.

12. An envelope according to claim 11, characterized in that said sealant is formed by a material having a melting point equal to or lower than 400° C.

13. An envelope according to claim 12, characterized in that said sealant includes a metal.

14. An envelope according to claim 13, characterized in that said sealant includes at least indium (In).

15. An envelope according to claim 14, characterized in that a surface processing material is arranged in a position of said members in contact with said sealant.

16. An envelope according to claim 15, characterized in that an electron source is arranged within the envelope.

17. An image-forming apparatus, comprising:

an envelope constructed by combining plural members and airtightly maintaining an internal space with respect to the exterior, characterized in that the envelope has a joining portion airtightly joining said members to each other by a sealant having a seal function, and said airtight joining is reinforced by an adhesive having an adhesive function; and an image-forming member arranged within the envelope.

18. An image-forming apparatus according to claim 17, further comprising an electron source arranged within said envelope, and said image-forming member forms an image by irradiating electrons outputted from said electron source.

19. An image-forming apparatus according to claim 18, further comprising a control electrode for controlling said electrons.

20. A manufacturing method of an envelope constructed by combining plural members and airtightly maintaining an internal space with respect to the exterior, said method characterized by comprising a first process for airtightly joining said members to each other by a sealant having a seal function and a second process for reinforcing said airtight joining by an adhesive having an adhesive function.

21. An image-forming apparatus according to claim 20, characterized in that said second process is performed after said first process.

22. An image-forming apparatus comprising:

a face plate;

a rear plate arranged so as to be opposite to said face plate;

an outer frame arranged between said face and rear plates and surrounding a circumstance;

a face plate joining portion for joining said outer frame and said face plate;

a rear plate joining portion for joining said outer frame and said rear plate to each other, with one or both of said face plate joining portion and said rear plate joining portion including a sealant having a seal function and an adhesive having an adhesive function; and a member for emitting light by electroluminescence arranged in an envelope formed within said face plate, said rear plate and said outer frame.

23. An image-forming apparatus according to claim 17, wherein said image-forming member is a member for emitting light by electroluminescence.

24. An envelope comprising:

plural members combined and airtightly maintaining an envelope having an internal space with respect to an exterior; and a sealant having a metal or an alloy, wherein the internal space between said members is airtightly sealed by said sealant; and a reinforcing portion reinforcing said envelope outside of the internal space sealed by said sealant.

25. An image-forming apparatus comprising:

an envelope constructed by combining plural members and airtightly maintaining an internal space with respect to an exterior, and including a sealant having a metal or an alloy, with the internal space between said members being airtightly sealed by said sealant;

a reinforcing portion reinforcing said envelope outside of the internal space sealed by said sealant; and an image-forming member arranged within said envelope.

26. An image-forming apparatus according to claim 25, further comprising an electron source arranged within said envelope, said image-forming member forming an image by irradiating electrons outputted from said electron source.

27. An image-forming apparatus according to claim 25, wherein said image-forming member is a member for emitting light by electroluminescence.

* * * * *

UNITED STATES PATENT AND TRADEMARK OFFICE

CERTIFICATE OF CORRECTION

PATENT NO. : 6,621,220 B1
DATED : September 16, 2003
INVENTOR(S) : Mitsutoshi Hasegawa et al.

It is certified that error appears in the above-identified patent and that said Letters Patent is hereby corrected as shown below:

Column 1,
Line 4, "con't" should read -- continuation --.

Signed and Sealed this

Thirteenth Day of April, 2004

JON W. DUDAS
*Acting Director of the United States Patent and Trademark Office*